US006990298B2

(12) United States Patent
Hamano et al.

(10) Patent No.: US 6,990,298 B2
(45) Date of Patent: Jan. 24, 2006

(54) IMAGE FORMING APPARATUS

(75) Inventors: Shigemichi Hamano, Chiba (JP); Akihiko Sakai, Chiba (JP); Kenji Morita, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 134 days.

(21) Appl. No.: 10/786,117

(22) Filed: Feb. 26, 2004

(65) Prior Publication Data

US 2004/0170450 A1 Sep. 2, 2004

(30) Foreign Application Priority Data

Feb. 28, 2003 (JP) ..... 2003-054415
May 1, 2003 (JP) ..... 2003-126415

(51) Int. Cl.
*G03G 15/16* (2006.01)

(52) U.S. Cl. ..... 399/66; 399/302; 399/308

(58) Field of Classification Search ..... 399/71, 399/66, 297, 302, 301, 308
See application file for complete search history.

(56) References Cited

U.S. PATENT DOCUMENTS 5,300,982 A * 4/1994 Inamoto et al. ..... 399/301
5,450,180 A 9/1995 Ohzeki et al.
6,445,900 B2 * 9/2002 Fukao et al. ..... 399/302

FOREIGN PATENT DOCUMENTS

| | | |
|---|---|---|
| JP | 2-123385 | 5/1990 |
| JP | 2000-231276 | 8/2000 |
| JP | 2001-175086 | 6/2001 |

* cited by examiner

*Primary Examiner*—Susan Lee
(74) *Attorney, Agent, or Firm*—Fitzpatrick, Cella, Harper & Scinto

(57) ABSTRACT

An image forming apparatus, including: an image forming portion for forming an image on an image bearing member, a first transfer portion for transferring the image on the image bearing member to an intermediate transfer body on a first transfer position, a second transfer portion which has a transfer member attachable and detachable to the intermediate transfer body and transfers the image on the intermediate transfer body to a transferring material on a second transfer position, and a cleaning portion which has a cleaning member attachable and detachable to the intermediate transfer body, brings the cleaning member into contact with a surface of the intermediate transfer body, and cleans the surface on a cleaning position, wherein control is performed so that a subsequent image forming area does not overlap the position which makes contact with the cleaning member and is not cleaned by the cleaning portion on the intermediate transfer body.

4 Claims, 19 Drawing Sheets

IMAGE FORMING APPARATUS

BACKGROUND OF THE INVENTION

1. Field of the Invention

The present invention relates to an image forming apparatus which transfers an image having been formed on an image bearing member to an intermediate transfer body and then transfers the image to a transferring material.

2. Related Background Art

Color electrophotographic image forming apparatuses using intermediate transfer bodies have been particularly proposed in recent years. The intermediate transfer body literally indicates a member for temporarily forming a visualized toner image and is characterized by an image forming process of retransferring the image from the intermediate transfer body to a sheet medium.

With such an intermediate transfer body, it is possible to prevent problems of transferring efficiency and a color drift that are caused by directly forming toner images on sheet mediums made of various materials with different thicknesses. Particularly with an intermediate transfer belt, the of the material enables a flexible arrangement in an apparatus, thereby advantageously reducing the size of the overall apparatus. Thus, the intermediate transfer body has received attention as a form having a variety of advantages.

In the formation of a color image on the intermediate transfer body, the following method is also available: latent images and toner images of colors are formed simultaneously on a plurality of photosensitive drums and are collectively transferred (primary transfer) to the intermediate transfer body, and a resultant color image formed on the intermediate transfer body is retransferred (secondary transfer) to a recording sheet medium (hereinafter this method will be referred to as a multiple drum method).

However, in the multiple drum method, the configuration of the apparatus requires a photosensitive drum and exposing means for each color of an image to be formed, resulting in a demerit of high cost. Hence, the following method is proposed: latent images and toner images of colors are formed on a single photosensitive drum at two or more times, the images are subjected to multiple transfers by rotating an intermediate transfer body, and thus a color image is formed (hereinafter this method will be referred to as a single drum method).

In the single drum method, the configuration requires only a single photosensitive drum and exposing means, achieving an advantage of lower cost as compared with the multiple drum method.

Further, when multiple images are formed while the intermediate transfer body is rotated, in order to prevent a color drift on the overlapped images of multiple colors, a sensor and the like are provided to detect the position of the intermediate transfer body, the timing of starting transfer is generated based on the timing of detecting the position, and thus problems such as a color drift are prevented. Since such a mechanism is necessary in the configuration, it can be said that the single drum method is more advantageous than the multiple drum method in view of a color drift. In the case where a monochrome image is formed, it is not necessary to consider a color drift and thus an image is generally transferred regardless of the timing of detecting a position.

However, since the single drum method forms multiple images while rotating the intermediate transfer body, a formed color toner image is retransferred (secondary transfer) to a recording sheet medium only when the color toner image is formed after the intermediate transfer body rotates two or more times. Therefore, the single drum method is less advantageous in productivity than the multiple drum method.

In addition, when the intermediate transfer body is used in normal times, a retransfer portion for performing retransfer on a recording sheet medium requires a mechanism (secondary transfer mechanism) which presses and attaches the recording sheet medium to the intermediate transfer body by using a roller and the like to efficiently retransfer toner images having been formed on the intermediate transfer body to the recording sheet medium. In the single drum method, when a rotation is made during the multiple transfers of images onto the intermediate transfer body, the images cannot be transferred to the recording sheet medium. Hence, structurally the secondary transfer mechanism has to be attachable and detachable to and from the intermediate transfer body.

That is, when a rotation is made during the image formation, the secondary transfer mechanism is detached from the intermediate transfer body. When the final color image is transferred, the secondary transfer mechanism is brought into contact with the intermediate transfer body and transfer is simultaneously performed to a recording sheet medium having been conveyed to a secondary transfer portion. When the transfer to the recording sheet medium is completed, the secondary transfer mechanism is detached from the intermediate transfer body again and is prepared for subsequent multiple images formed on the intermediate transfer body.

Moreover, an intermediate transfer method is characterized in that a mechanism (transfer cleaning mechanism) is structurally necessary to scrub away a residue of a toner image having been transferred from the intermediate transfer body to the recording sheet medium. In the single drum method, the transfer cleaning mechanism also has to be attachable and detachable to and from the intermediate transfer body for the same reason as the secondary transfer mechanism.

The transfer cleaning mechanism is generally configured so that the end of a cleaning blade for scrubbing away residual toner on the intermediate transfer body is attachable and detachable to and from a surface of the intermediate transfer body. When the cleaning blade is detached from the intermediate transfer body, a mark of residual toner (so-called blade mark) may remain on the intermediate transfer body. When the blade mark overlaps an image transfer position in the subsequent image formation, an image transfer surface may be contaminated and form a faulty toner image on the intermediate transfer body. Hence, in the conventional technique, the following control is performed: position detection means, which is essential in the configuration of the single drum method, is used to detach the transfer cleaning mechanism in an area other than an image forming (transferring) area, so that a faulty image is prevented in the subsequent image formation. Such a technique is disclosed in Japanese Patent Application Laid-Open No. 2001-175086 and Japanese Patent Application Laid-Open No. 2000-231276.

Further, regarding a conventional transfer control technique, "applied transfer voltage control" is adopted, in which in order to prevent faulty transfer and a paper mark that are caused by fluctuations in the resistance of a transfer roller, the resistance (voltage-current characteristics) of the transfer roller is measured at, for example, pre-rotation when no image is formed, and a transfer voltage applied to the transfer roller is properly controlled according the measurement result. Such applied transfer voltage control means includes ATVC control (Active Transfer Voltage Control) which is disclosed in Japanese Patent Application Laid-Open No. H2-123385.

However, after due consideration of the blade mark, the applicant et al. found the following problems:

First, the blade mark may appear on the attaching position of the blade as well as at the detachment of the blade.

Second, in transfer control such as the ATVC for detecting the resistance of the transfer roller, when the blade mark is present during the detection of a resistance, a resistance cannot be precisely detected and thus the optimum transfer control cannot be performed.

Third, in the conventional technique, a faulty image cannot be sufficiently prevented merely by keeping a detachment mark of the blade out of an image forming area. For example, even if a blade mark is positioned out of an image forming surface, when the secondary transfer mechanism is in contact with the intermediate transfer body, the passage of the blade mark on the intermediate transfer body through a secondary transfer portion may cause residual toner to adhere to the surface of the secondary transfer portion. The residual toner may be retransferred to the intermediate transfer body, increase a contaminated area on the surface of the intermediate transfer body, and indirectly cause a faulty image.

Additionally, a transfer cleaner is detached in various image adjusting operations as well as image formation. An example of the image adjusting operations includes so-called patch correction control, in which the concentration of toner is adjusted by reading, with a sensor, the concentration of a toner image formed on the intermediate transfer body, and so-called belt writing control, in which since a friction may become too large between the cleaning blade and the intermediate transfer body and resistance may curl up the blade, a black toner belt is placed as a lubricant on the intermediate transfer body by force and is scrubbed away by the cleaning blade. Also in these cases, it is necessary to scrub away residual toner on the intermediate transfer body in the end and a blade mark may remain on the intermediate transfer body as in the image formation. Such image adjusting operations may be performed during a series of image forming operations and may be collectively performed at the completion or immediately before the operations. Further, in the event of unforeseen circumstances such as a jam of a recording sheet medium, an unexpected error and power shutdown, a special image adjusting operation may be performed at the completion or immediately before the operations. All of these operations may adversely affect the subsequent image formation.

SUMMARY OF THE INVENTION

The present invention is devised in view of the above problems and the object of the present invention is to prevent a detrimental effect caused by a mark of the attachment/detachment of cleaning means.

In order to attain the object, a preferred embodiment of the present invention is an image forming apparatus, comprising:

image forming means for forming an image on an image bearing member, first transfer means for transferring the image on the image bearing member to an intermediate transfer body on a first transfer position, second transfer means which has a transfer member attachable and detachable to the intermediate transfer body and transfers the image on the intermediate transfer body to a transferring material on a second transfer position, cleaning means which has a cleaning member attachable and detachable to the intermediate transfer body, brings the cleaning member into contact with a surface of the intermediate transfer body, and cleans the surface on a cleaning position, and control means for performing control so that a subsequent image forming area does not overlap the position which makes contact with the cleaning member and is not cleaned by the cleaning means on the intermediate transfer body.

Another preferred embodiment is an image forming apparatus, comprising:

image forming means for forming an image on an image bearing member, first transfer means for transferring the image on the image bearing member to an intermediate transfer body on a first transfer position, second transfer means which has a transfer member and transfer output means and transfers the image on the intermediate transfer body to a transferring material on a second transfer position, the transfer means being attachable and detachable to the intermediate transfer body, the transfer output means applying a transfer output to the transfer member, the second transfer means performing voltage-current detection on the transfer member when no image is formed and determining the transfer output of the transferring operation based on the detection results of the detecting operation, cleaning means which has a cleaning member attachable and detachable to the intermediate transfer body, brings the cleaning member to a surface of the intermediate transfer body, and cleans the surface on a cleaning position, and control means for performing control so that a detecting area of the detecting operation does not overlap the position which is in contact with or separated from the cleaning member and is not cleaned by the cleaning means on the intermediate transfer body.

Still another preferred embodiment is an image forming apparatus, comprising:

image forming means for forming an image on an image bearing member, first transfer means for transferring the image on the image bearing member to an intermediate transfer body on a first transfer position, second transfer means which has a transfer member attachable and detachable to the intermediate transfer body and transfers the image on the intermediate transfer body to a transferring material on a second transfer position, cleaning means which has a cleaning member attachable and detachable to the intermediate transfer body, brings the cleaning member into contact with a surface of the intermediate transfer body, and cleans the surface on a cleaning position, and control means for performing control so that a contact area in a subsequent contacting operation of the transfer member and an image forming area do not overlap the position which makes contact with the cleaning member and is not cleaned by the cleaning means on the intermediate transfer body.

DESCRIPTION OF THE PREFERRED EMBODIMENTS

An embodiment of the present invention will be described below.

Embodiment 1

(Basic Structure of an Image Forming Apparatus and an Image Forming Sequence)

Figure 1:
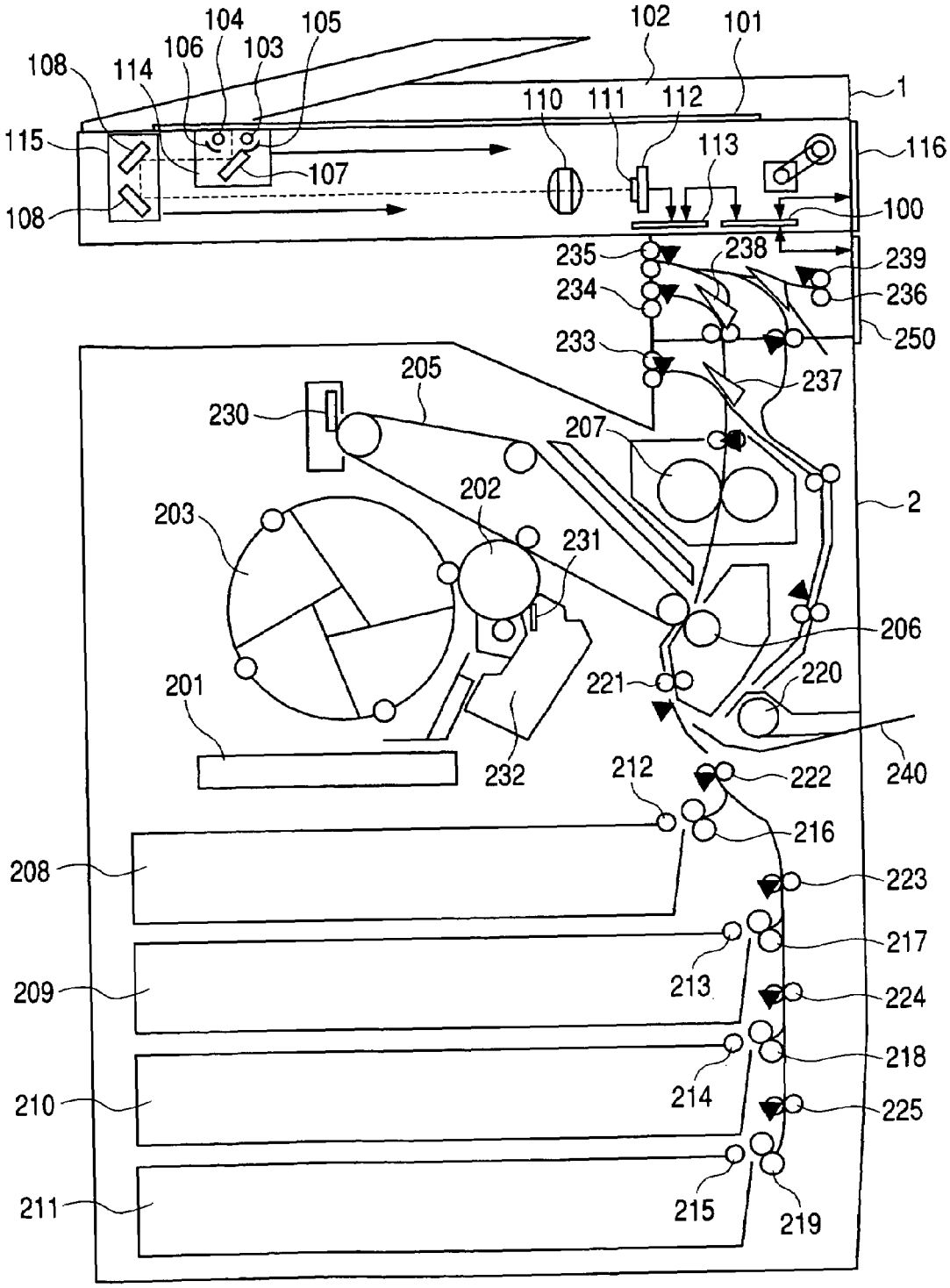
FIG. 1 is a diagram showing a schematic configuration according to Embodiment 1 of the present invention.

Referring to FIG. 1 showing the schematic configuration of a full-color image forming apparatus according to an embodiment of the present invention, the basic configuration of the image forming apparatus and an image forming sequence will be described below.

First the configuration of a color reader 1 will be discussed below. Reference numeral 101 denotes a platen glass (platen) and reference numeral 102 denotes an automatic document feeder (ADF). Instead of the automatic document feeder 102, a mirror platen or a white platen (not shown) may be mounted. Reference numerals 103 and 104 denote light sources for illuminating an original. Light sources such as a halogen lamp, a fluorescent lamp and a xenon tube lamp are used. Reference numerals 105 and 106 denote reflecting shades for condensing light from the light sources 103 and 104 onto an original. Reference numerals 107 to 109 denote mirrors. Reference numeral 110 denotes a lens for condensing reflected light or projected light from an original onto a CCD (charge-coupled device) image sensor (hereinafter, referred to as a CCD) 111. Reference numeral 112 denotes a board where the CCD 111 is mounted. Reference numeral 100 denotes a control portion for controlling the overall image forming apparatus. Reference numeral 113 denotes a digital image processing portion. Reference numeral 114 denotes a carriage for housing the light sources 103 and 104, the reflecting shades 105 and 106 and the mirror 107. Reference numeral 115 denotes a carriage for housing the mirrors 108 and 109. The carriage 114 at a velocity of V and the carriage 115 at a velocity of V/2 are mechanically moved along a sub-scanning direction Y which is orthogonal to the electrical scanning direction (main-scanning direction X) of the CCD 111, so that scanning is performed over the surface of an original. Reference numeral 116 denotes an external interface (I/F) with another device.

Figure 2:
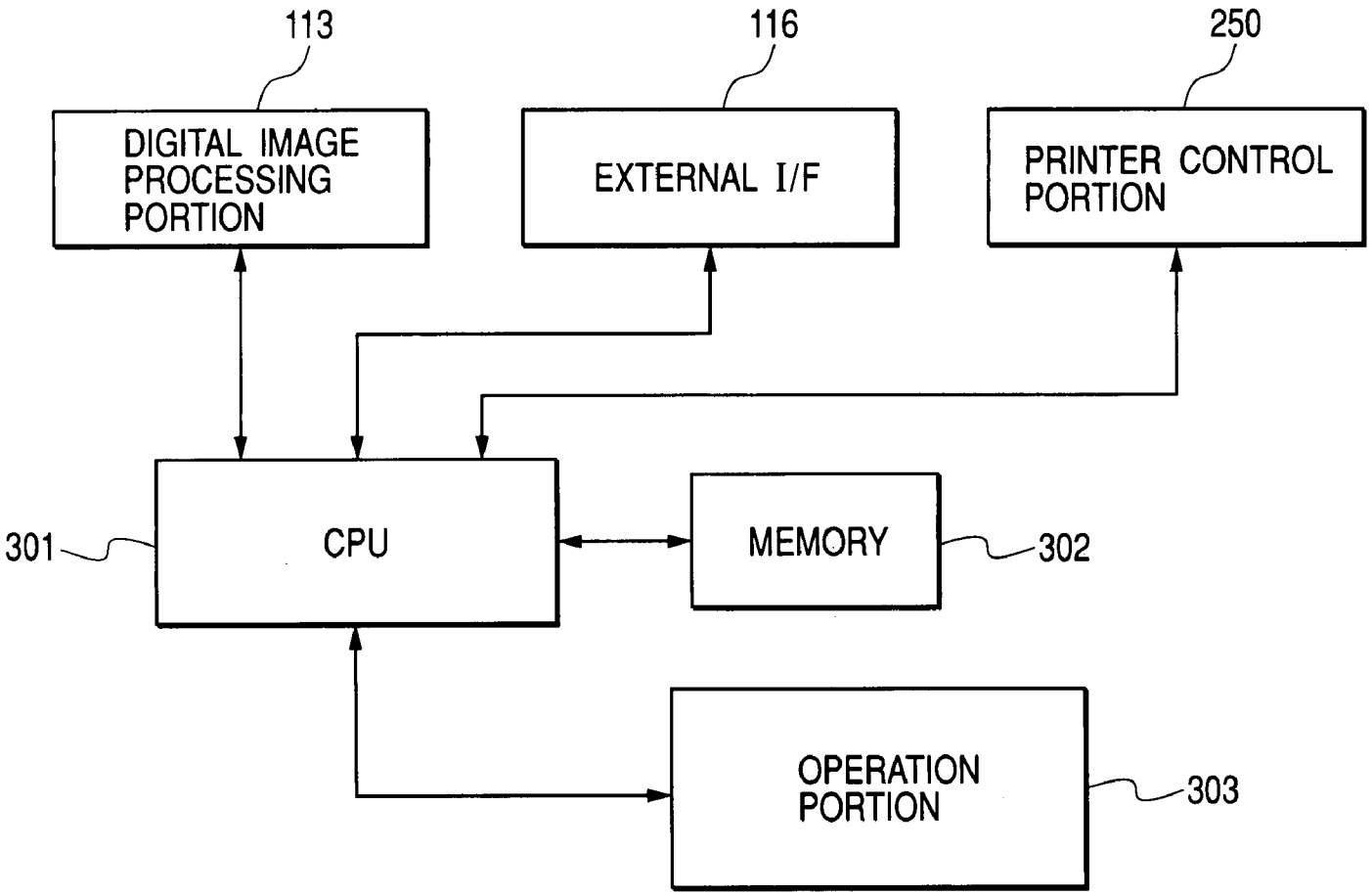
FIG. 2 is a block diagram showing the control portion of an image forming apparatus according to Embodiment 1 of the present invention.

As shown in FIG. 2, a control portion 100 is constituted of a CPU 301, which has an I/F for exchanging information for controlling a digital image processing portion 113 and a printer control portion 250 and exchanges information with other devices via an external interface, an operation portion 303 and a memory 302. The operation portion 303 is constituted of a liquid crystal display with a touch panel which permits an operator to input execution contents and to be notified of information and a warning about processing.

Figure 3:
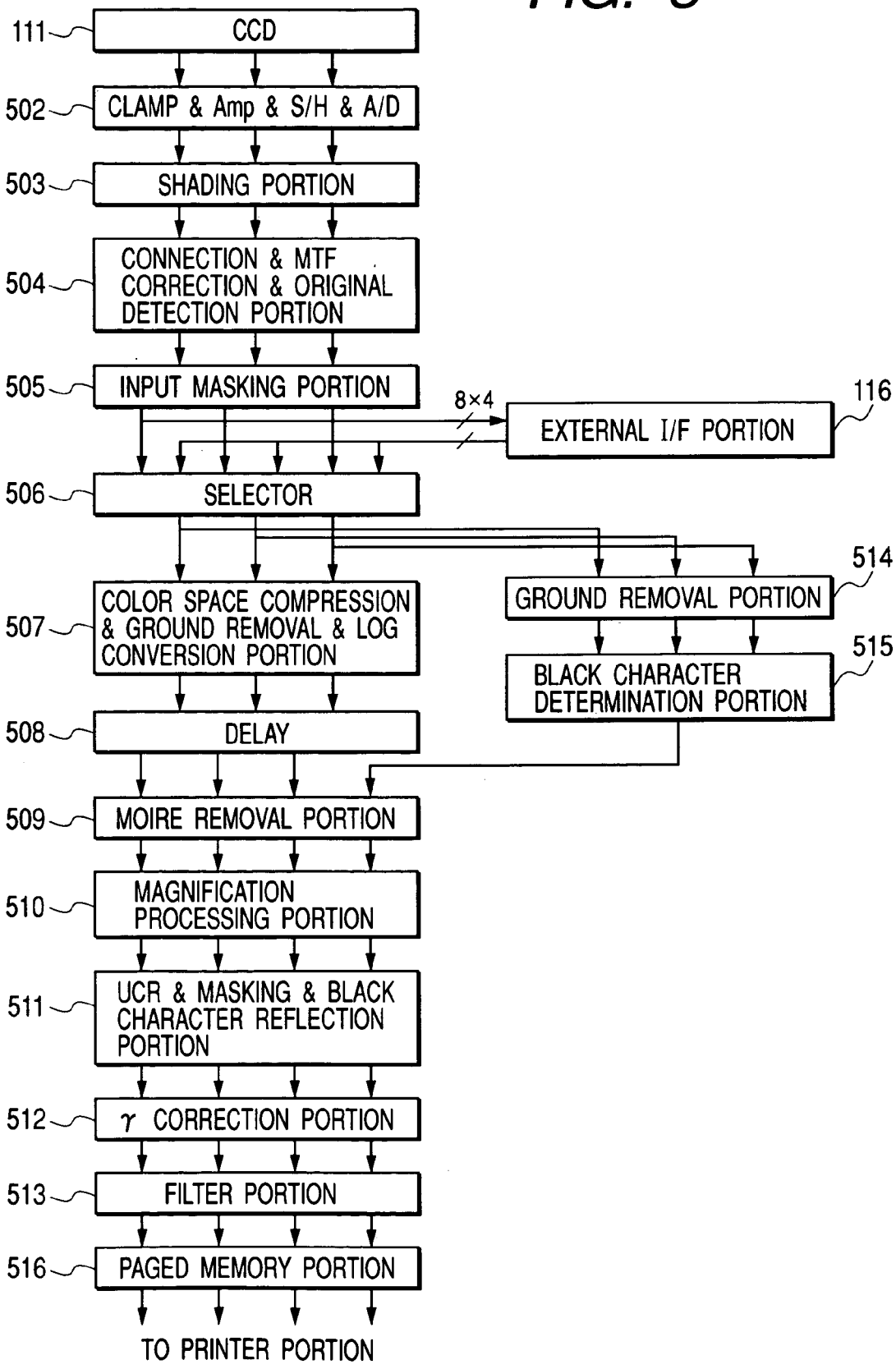
FIG. 3 is a diagram showing the configuration of a main part of a digital image processing portion from CCD input to a printer portion when an image is read according to Embodiment 1 of the present invention.

The digital image processing portion 113 will be described in detail. FIG. 3 is a block diagram showing the specific configuration of the digital image processing portion 113.

An original on the platen glass reflects light from the light sources 103 and 104, and the reflected light is directed to the CCD 111 and is converted into an electrical signal (when the CCD 111 is a color sensor, RGB color filters may be arranged in line in RGB order on a one-line CCD, and when the CCD 111 is a three-line CCD, an R filter, a G filter and a B filter may be arranged for each CCD. Further, a filter may be arranged on-chip or may be arranged separately from a CCD.).

Then, the electrical signal (analog image signal) is inputted to the image processing portion 113 and is subjected to sampling and holding (S/H) in a clamp & Amp & S/H & A/D portion 502. The dark level of the analog image signal is clamped at the reference potential, is amplified to a predetermined amount (the processing order is not limited to the illustrated order and processing may be performed in a different order), and is subjected to AD conversion, so that the signal is converted into a digital signal of 8-bit RGB.

Subsequently the RGB signal is subjected to shading correction and black correction in a shading portion 503. Thereafter, in a connection & MTF correction & original detection portion 504, considering that lines are read on different positions when the CCD 111 is a three-line CCD, connection processing adjusts a delay amount for each line according to a reading velocity and corrects signal timing so that three lines are read on the same position. Since the reading MTF is varied according to a reading velocity and a magnification factor, MTF correction corrects the change. Original detection recognizes the size of an original by scanning the original on the platen glass.

The digital signal whose reading position timing has been corrected corrects the spectral characteristic of the CCD 111 and the spectral characteristics of the light sources 103 and 104 and the reflecting shades 105 and 106 by using an input masking portion 505.

The output of the input masking portion 505 is inputted to a selector 506 which can be switched with an external I/F signal.

A signal outputted from the selector 506 is inputted to a color space compression & ground removal & LOG conversion portion 507 and a ground removal portion 514. The signal inputted to the ground removal portion 514 is inputted to a black character determination portion 515, which decides whether an original has a black character or not, after a ground is removed. Then, a black character signal is generated from the original. In the color space compression & ground removal & LOG conversion portion 507 having received the other output of the selector 506, color space compression decides whether a read image signal is within the reproducible range of a printer. When the image signal is within the range, the signal is left as it is. When the image signal is out of the range, the image signal is corrected so as to be within the reproducible range of the printer. Then, a ground is removed and conversion is made from an RGB signal to a YMC signal in a LOG conversion portion. Subsequently, in order to correct timing relative to the signal generated by the black character determination portion 515, the output signal of the color space compression & ground removal & LOG conversion portion 507 is adjusted in timing by a delay 508.

The moiré of the two kinds of signals is removed by a moiré removal portion 509 and is scaled along the main scanning direction by a magnification processing portion 510.

Reference numeral 511 denotes a UCR & masking & black character reflection portion. Regarding the signal processed in the magnification processing portion 510, a YMCK signal is generated from the YMC signal by UCR processing and is corrected into a signal according to the output of the printer in a masking portion, and a determination signal generated by the black character determination portion 515 is fed back to the YMCK signal.

The signal processed in the UCR & masking & black character reflection portion 511 is adjusted in density by a γ correction portion 512 and is subjected to smoothing or edging in a filter portion 513.

The processed image data is stored in a page memory 516 and is outputted to the printer in synchronization with the image formation of the printer.

The configuration of a color printer 2 will be described below. In FIG. 1, reference numeral 250 denotes a printer control portion which receives a control signal from the CPU 301 on the control portion 100 serving as the control portion of the overall image forming apparatus. The control portion 100 performs the foregoing image reading control on the color reader 1, so that reading image data is temporarily stored in the memory 302 on the control portion, and image data on the memory is transmitted as an image data signal to the printer control portion 250 in synchronization with a video clock according to the reference timing from the printer control portion 250.

The printer portion performs an operation, which will be discussed later, based on the control signal from the printer control portion 250. Reference numeral 201 denotes a laser scanner which scans a laser beam corresponding to an image data signal along the main scanning direction by using a polygon mirror and emits the laser beam to a photosensitive drum 202 serving as an image bearing member. An electrostatic latent image formed on the photosensitive drum 202 is caused to reach the sleeve position of one of four-color developing rotaries by the clockwise rotation of the photosensitive drum 202. Toner is formed according to a potential between the photosensitive drum 202 bearing the electrostatic latent image and a developing sleeve surface where developing bias is applied, and the toner is flicked from color developing devices 203 to the surface of the photosensitive drum 202 so as to form the electrostatic latent image on the surface of the photosensitive drum 202.

A toner image formed on the photosensitive drum 202 is transferred to an intermediate transfer body (intermediate transfer means) 205, which rotates counterclockwise, by the clockwise rotation of the photosensitive drum 202. In the case of a monochrome image, images are sequentially formed on the intermediate transfer body 205 at predetermined time intervals, so that primary transfer is completed. In the case of a full-color image, for electrostatic latent images corresponding to colors on the photosensitive drum, sleeve positioning of the developing rotaries is performed sequentially for each of the colors and developing/primary transfer is performed. After four rotations of the intermediate transferring body 205, that is when primary transfer is completed for four colors, the primary transfer of the full-color image is completed.

A recording paper (transferred medium) is picked up from cassettes (upper cassette 208/lower cassette 209/third cassette 210/fourth cassette 211) by pickup rollers 212/213/214/215 of the cassettes and is conveyed by feed rollers 216/217/218/219 of the cassettes. The recording paper is conveyed to registration rollers 221 by vertical path conveying rollers 222/223/224/225. In the case of manual feeding, recording papers stacked on a manual feed tray 240 are conveyed to the registration rollers 221 by a manual feed roller 220.

At the completion of transfer to the intermediate transfer body 205, the recording paper is conveyed to the nip between the intermediate transfer body 205 and a secondary transfer roller 206. Thereafter, the recording paper is conveyed to a fixing device and is attached to the intermediate transfer body 205 by pressure while being nipped between the secondary transfer roller 206 and the intermediate transfer body 205, so that a toner image on the intermediate transfer body 205 is subjected to secondary transfer on the recording paper. The toner image having been transferred to the recording paper is heated and pressed by a fixing roller and a press roller 207 so as to be fixed on the recording paper. Besides, regarding toner remaining on the intermediate transfer body 205 without being transferred to the recording paper, a cleaning blade (cleaning member) capable of contacting and separating is caused to rub against the surface of the intermediate transfer body 205 to scrub the residual toner away from the surface of the intermediate transfer body 205, so that cleaning is made by aftertreatment control in the last half of the image forming sequence. In a photosensitive drum unit, residual toner is scrubbed away from the surface of the drum by a blade 230 and is carried to a waste toner box 232, which is integrated with the photosensitive drum unit. Further, a secondary transfer positive bias and a secondary transfer reverse bias are alternately applied to residual toner of positive and negative polarities on the surface of the secondary transfer roller 206. The residual toner may be adsorbed due to unforeseen circumstances. Then, the residual toner of polarities is adsorbed on the intermediate transfer body 205 and the residual toner is scrubbed by the intermediate cleaning blade 230, so that the residual toner is completely cleaned and the aftertreatment control is completed. In this case, cleaning driving control means is constituted of the printer control portion 250. Alternatively, the cleaning driving control means is constituted of the printer control portion 250 and the control portion 100.

In the first ejection, the recording paper having a fixed image thereon is ejected to discharge rollers 233 after a first discharge flapper 237 is switched to a first discharge roller direction. In the second ejection, the recording paper is ejected to discharge rollers 234 after the first discharge flapper 237 and a second discharge flapper 238 are switched to a second discharge roller direction. In the third ejection, in order to cause reverse rollers 235 to perform a reversing operation once, the first discharge flapper and the second discharge flapper are switched to the direction of the reverse rollers 235 so that the recording paper is reversed by the reverse rollers 235. After the recording paper is reversed by the reverse rollers 235, the recording paper is ejected to third discharge rollers 236 after a third discharge flapper is switched to a third discharge direction. In the case of ejection for both sides of a recording paper, the reversing operation is performed once by the reverse rollers 235 as in the third ejection, the third discharge flapper is switched to the direction of a double-sided unit, and the recording paper is conveyed to the double-sided unit. The recording paper is temporarily stopped after a predetermined time since the recording paper is detected by a double-sided sensor. The recording sheet is fed again upon preparation of an image and the image is formed on the second side.

(Attachment/detachment Control of the Cleaning Blade)

The following will describe the attachment/detachment control of the cleaning blade according to the present invention. FIGS. 4A to 4D show the relationship between stains on the intermediate transfer body at the attachment/detachment of the cleaning blade and an image area where an image is formed.

Figure 4A:
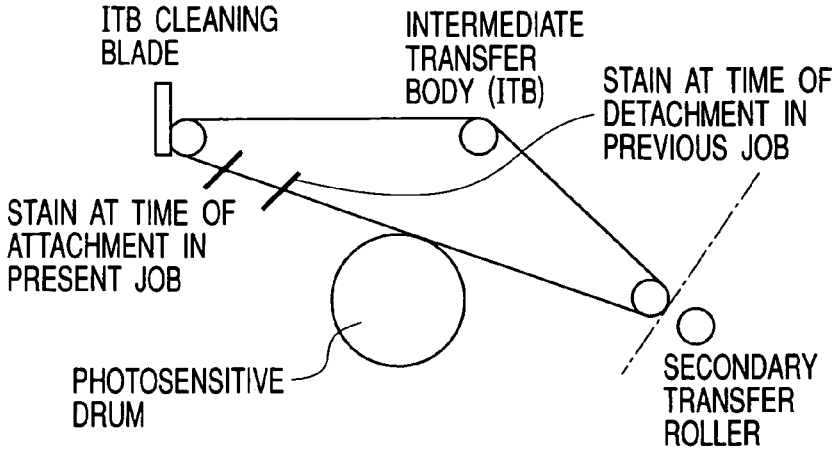
FIGS. 4A, 4B, 4C, 4D, 4E and 4F are diagrams showing the positional relationships of an intermediate transfer body and controlling steps.
Figure 4B:
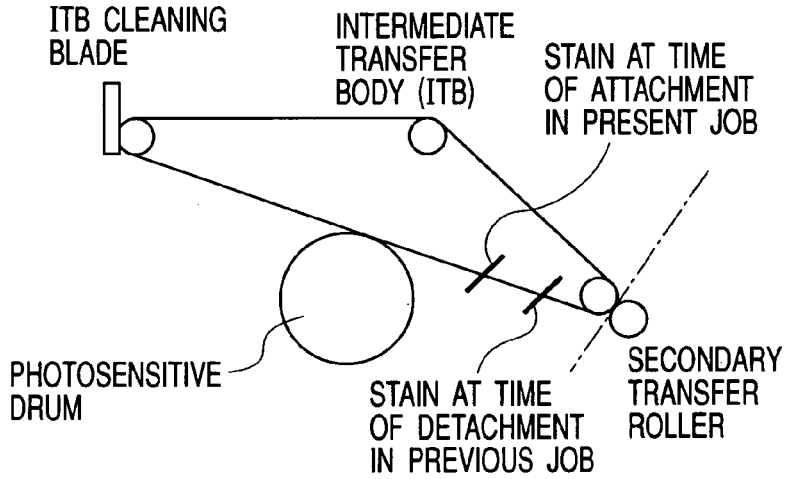

First FIG. 4A shows a state after the cleaning blade is contacted after the intermediate transfer body (ITB) starts rotating when pre-rotation is started prior to image formation after a job is inputted. In FIG. 4A, the intermediate transfer body (ITB) rotates counterclockwise, so that a stain is made away from the cleaning blade when the cleaning blade is separated (detachment in FIG. 4A) at the end of the previous job and a stain is made closer to the cleaning blade when the cleaning blade is contacted (attachment in FIG. 4A) at the beginning of the present job.

The pre-rotation will be discussed below. The pre-rotation is performed in FIG. 4A and FIG. 4B. The pre-rotation starts from the rotations of the intermediate transfer body and the drum. First the cleaning blade is contacted and cleaning is performed on residual toner which may remain on the intermediate transfer body in the previous job. At this point of time, a stain having adhered to the cleaning blade (stain at the time of attachment in the present job of FIG. 4A) adheres to the intermediate transfer body.

Further, along with the start of the rotation of the intermediate transfer body, secondary transfer ATVC control is performed to achieve the optimum secondary transfer control. The ATVC control is a transfer control method whereby voltage-current characteristics (impedance characteristics of the transfer roller) are detected when no image is formed and a voltage applied in the transfer is determined based on the detection results. In the secondary transfer ATVC control of the present embodiment, the secondary transfer roller is brought into contact with the intermediate transfer body (FIG. 4B), secondary transfer voltage values of several points are applied for sampling, and an analog signal of a secondary transfer current is sampled for each applied voltage. The sampled analog signal of the secondary transfer current is subjected to AD conversion. Then, a transfer voltage in the transfer is determined based on the detected signal.

In the secondary transfer ATVC control, if a stain like residual toner adheres to the intermediate transfer body at the detection of the impedance of the transfer roller, the level of the analog signal of the sampled secondary transfer current would become abnormal, resulting in no proper transfer voltage. Hence, in the present invention, it is necessary to control the timing of attachment/detachment of the cleaning blade so that the area of a stain caused by the attachment/detachment of the cleaning blade does not enter a detection area at the detection of impedance in the secondary transfer ATVC. Thus, for example, the intermediate transfer body is stopped immediately after the cleaning blade is separated (FIG. 4F) in the present invention, considering the fact that immediately before a main body is stopped after image formation, the position of separating the cleaning blade has to be out of the area of the secondary transfer ATVC control which is performed in the pre-rotation of the subsequent job.

Figure 4C:
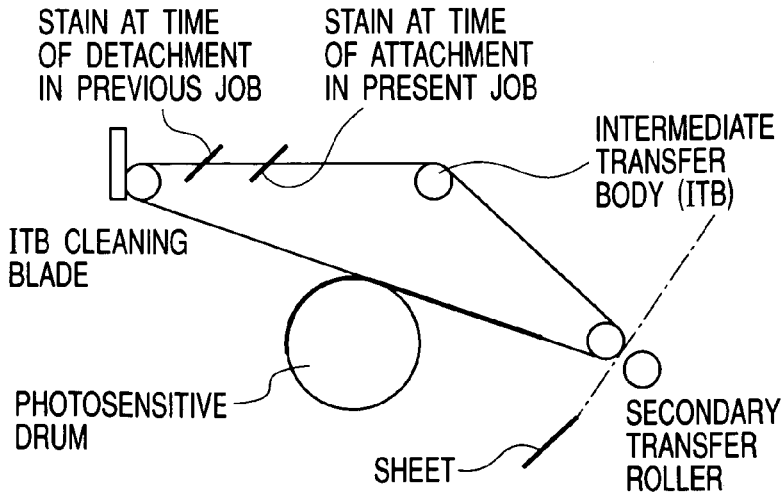

FIG. 4C shows that pre-rotation is completed and a formed toner image is being subjected to primary transfer on the intermediate transfer body. At this point of time, the stain area having adhered to the intermediate transfer body is positioned near the cleaning blade. With the passage of time, a stain having adhered upon detachment of the cleaning blade at the end of the previous job and a stain having adhered at the beginning of the present job are cleaned by the cleaning blade.

When the end of an image having undergone primary transfer on the intermediate transfer body approaches the cleaning blade, the cleaning blade is separated again (FIG. 4D) and remains separated (detached) from the intermediate transfer body until toner images of four colors are subjected to primary transfer on the intermediate transfer body.

Figure 4D:
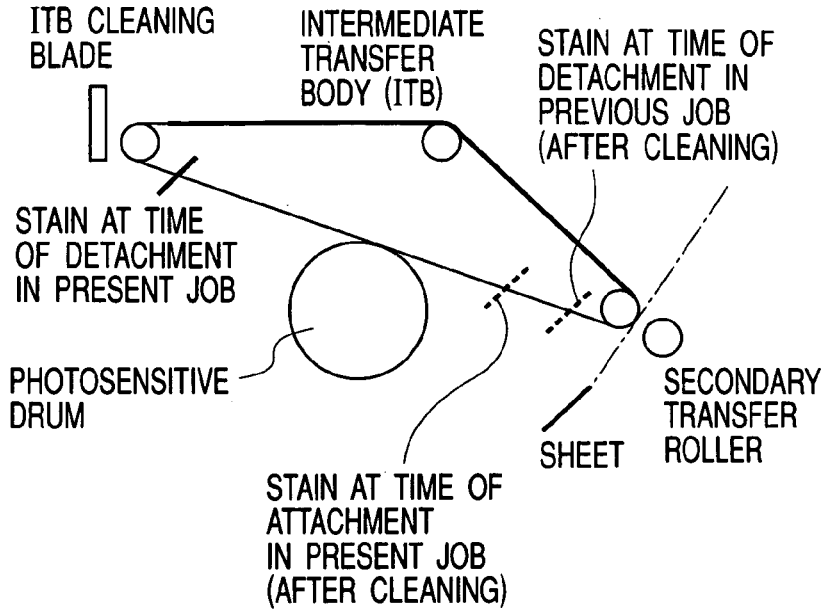
Figure 4E:
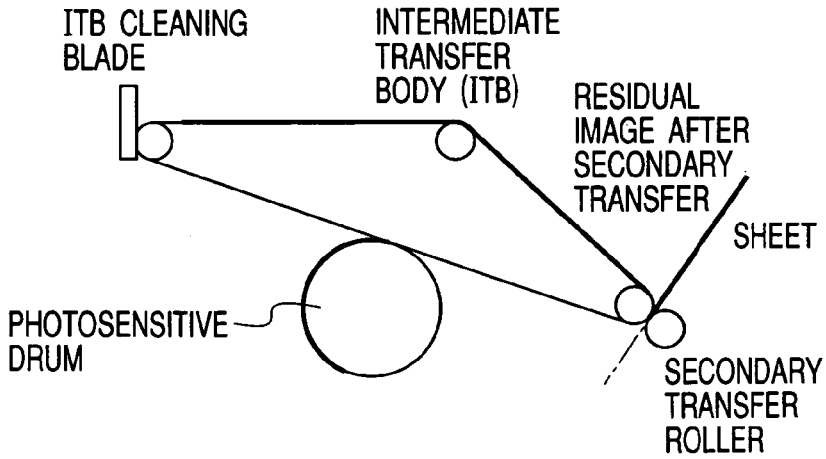

FIG. 4E shows a state immediately after the toner images of four colors are all subjected to primary transfer on the intermediate transfer body and secondary transfer is performed on a sheet. FIG. 4E shows that a residual image having not been completely transferred (secondary transfer) to the sheet approaches the cleaning blade. In order to clean the residual image, the cleaning blade having been separated (detached) is brought into contact (attached).

In FIG. 4E, primary transfer has been started immediately afterward for a first color image of the subsequent page. When the image having been additionally subjected to primary transfer advances and approaches the cleaning blade, the cleaning blade is separated as in the first page (FIG. 4D).

Figure 4F:
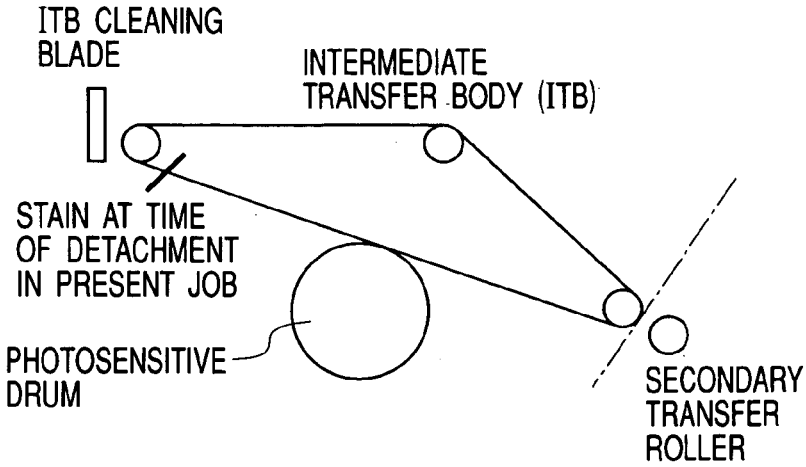

Between sheets of full-color images, the cleaning blade is separated in FIG. 4D because a toner image approaches immediately afterward in which the first color of a regular image has been subjected to primary transfer. When images are spaced between sheets in patch detection and the like (not shown), the cleaning blade remains contacted without being separated. In this case, for example, cleaning is continued to clean a patch afterimage. FIG. 4F shows that cleaning is completed after the formation of all images, the cleaning blade is separated, and the driving of the intermediate transfer body and the photosensitive drum are stopped immediately afterward. As described above, for the secondary transfer ATVC control to be performed in the pre-rotation of the subsequent job, the intermediate transfer body is stopped immediately after the cleaning blade is separated.

Figure 5:
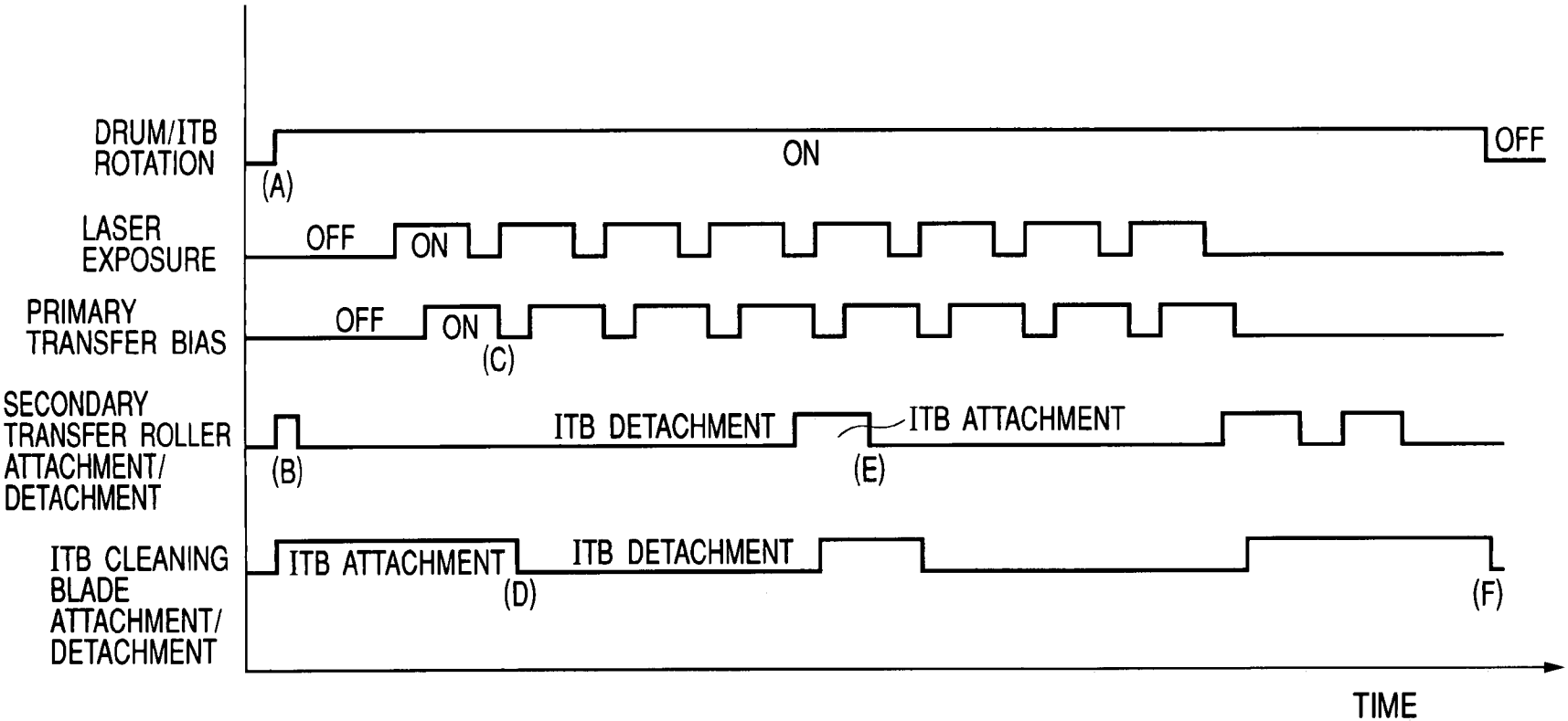
FIG. 5 is a diagram showing a timing chart according to Embodiment 1 of the present invention.

FIG. 5 shows a timing chart indicating a series of sequences when full-color images are formed on consecutive two pages. FIG. 5 shows, from the above, operations of driving drum/intermediate transfer body (ITB), a laser exposure signal, a primary transfer bias signal, a primary transfer bias signal, a secondary transfer roller attachment/detachment signal, and an intermediate transfer body cleaning blade attachment/detachment signal. FIG. 5 also shows timing positions corresponding to FIGS. 4A to 4F.

According to the above-described embodiment, it is possible to prevent a stain adhered by the cleaning member from degrading image quality or affecting other processing.

Embodiment 2

Figure 6:
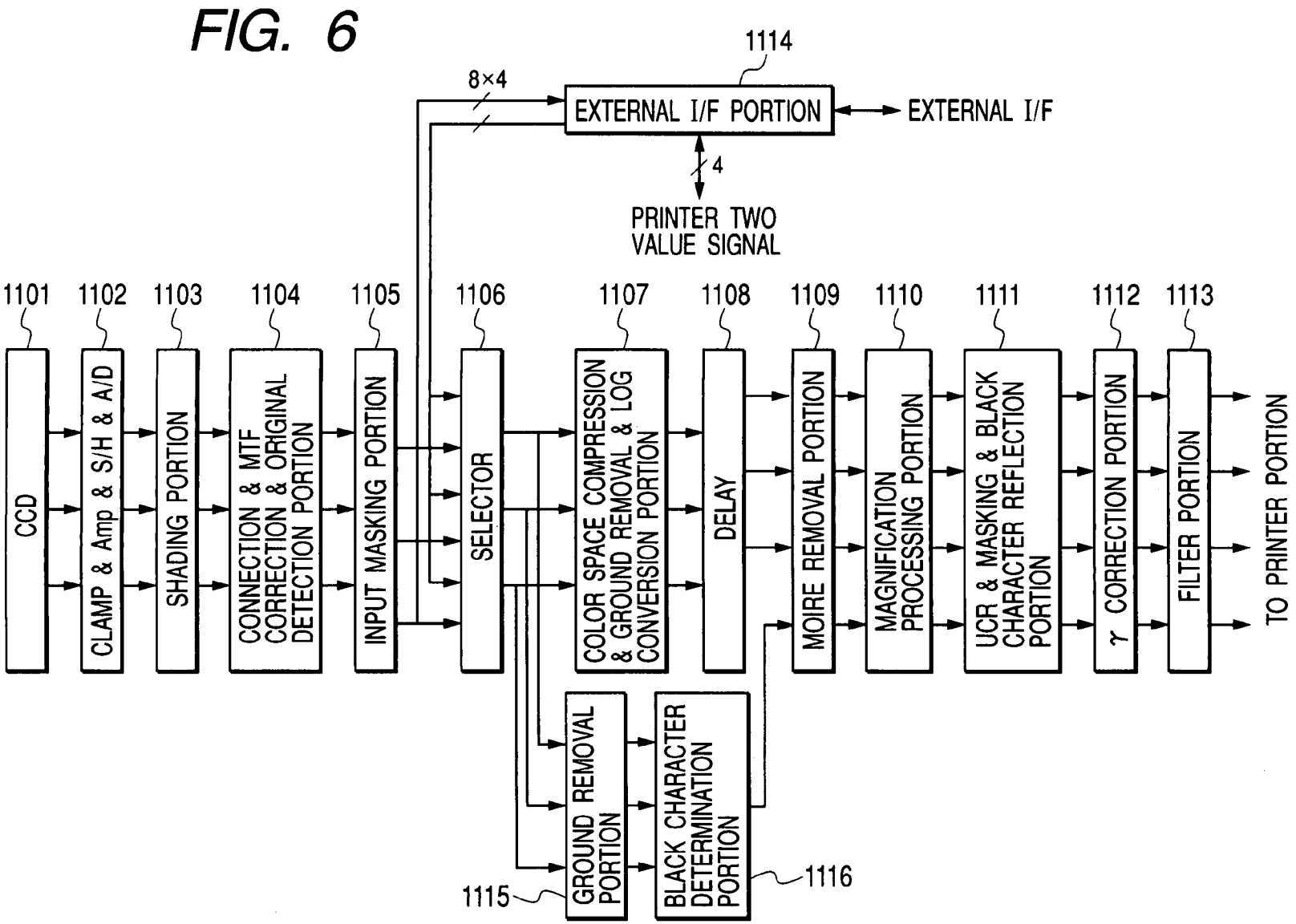
FIG. 6 is a block diagram showing the configuration of an image digital image processing portion.
Figure 7:
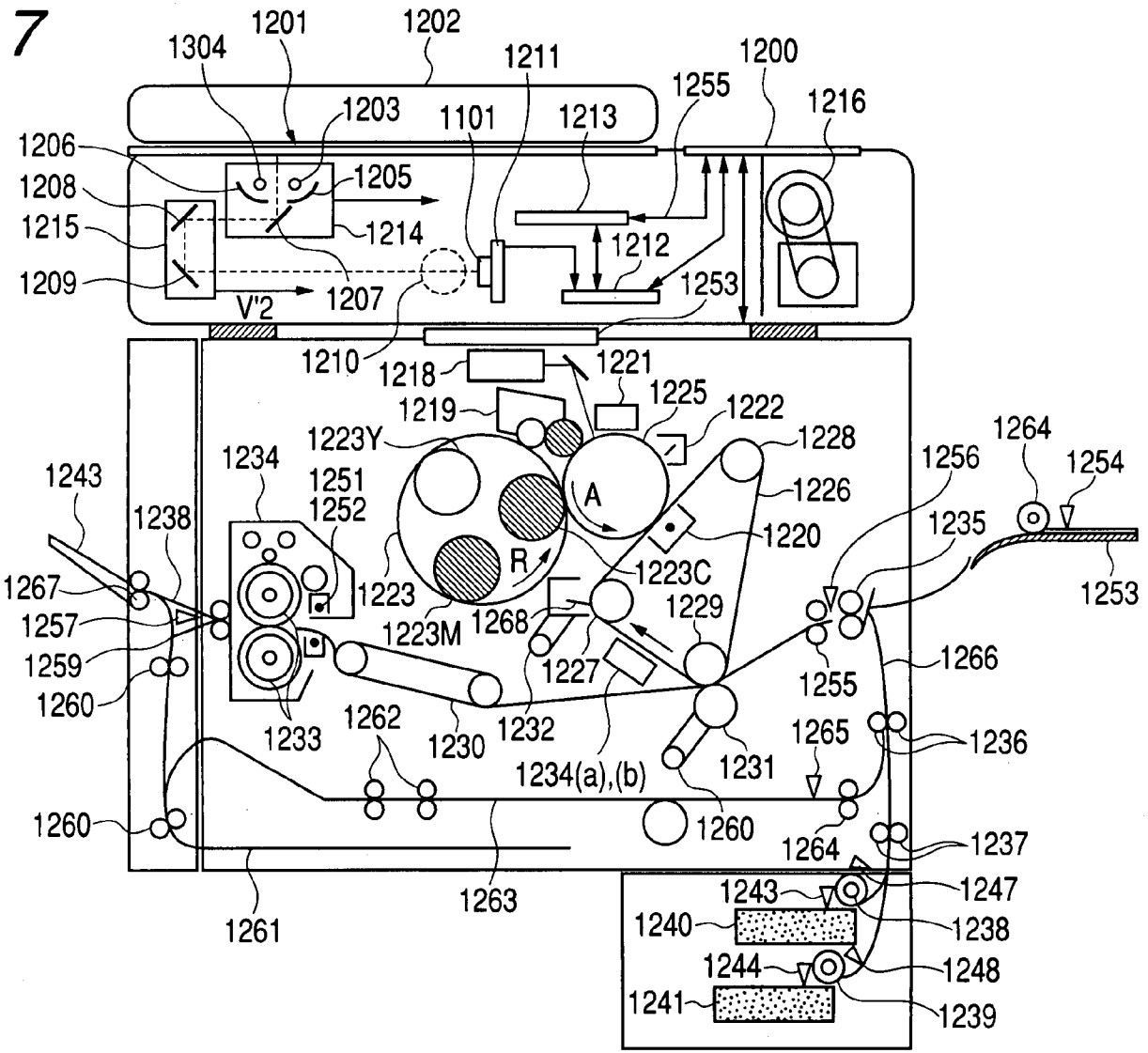
FIG. 7 is a diagram showing the overall configuration of the image forming apparatus.
Figure 8:
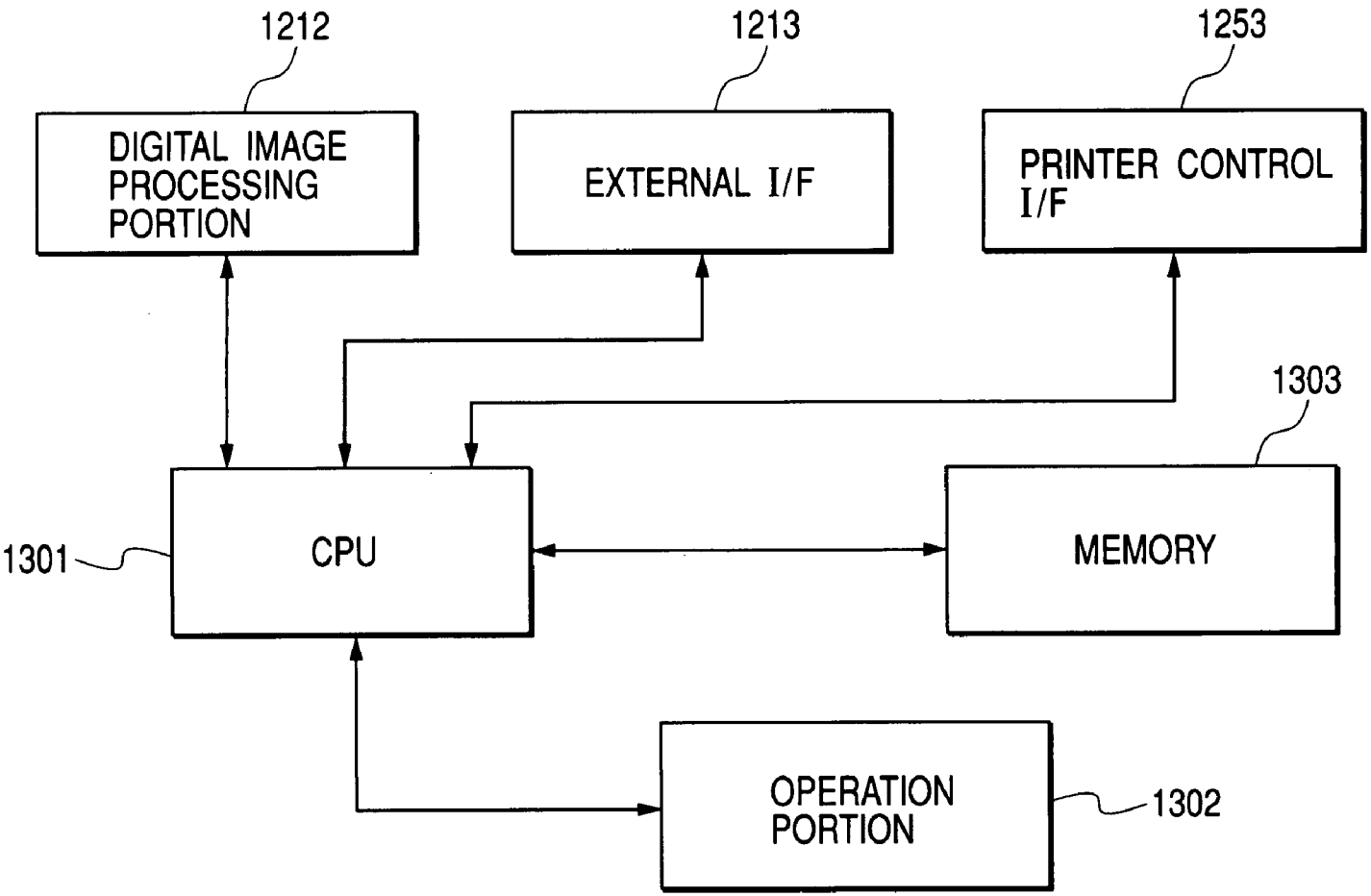
FIG. 8 is a block diagram showing the configuration of a control portion.

FIGS. 6 to 8 are diagrams showing the configuration of an image forming apparatus according to Embodiment 2 of the present invention. A basic configuration will be discussed below in accordance with the drawings.

(Configuration of a Color Reader)

The following will first describe the configuration of a color reader.

FIG. 7 shows the overall configuration of the image forming apparatus. Reference numeral 1101 denotes a CCD. Reference numeral 1211 denotes a board where the CCD 1101 is mounted. Reference numeral 1200 denotes a control portion for controlling the overall image forming apparatus. Reference numeral 1212 denotes a printer processing portion which includes the portions of the image processing portion of FIG. 1 except for the CCD 1101. Reference numeral 1201 denotes a platen glass (platen). Reference numeral 1202 denotes a document feeder (DF) (a mirror platen (not shown) may be mounted instead of the document feeder 1202). Reference numerals 1203 and 1204 denote light sources (halogen lamp or fluorescent lamp) for illuminating an original. Reference numerals 1205 and 1206 denote reflecting shades for condensing light from the light sources 1203 and 1204 onto an original. Reference numerals 1207 to 1209 denote mirrors. Reference numeral 1210 denotes a lens for condensing reflected light or projected light from an original onto the CCD 1101. Reference numeral 1214 denotes a carriage for housing the halogen lamps 1203 and 1204, the reflecting shades 1205 and 1206 and the mirror 1207. Reference numeral 1215 denotes a carriage for housing the mirrors 1208 and 1209. Reference numeral 1213 denotes an external interface (I/F) with other devices. The carriage 1214 at a velocity of V and the carriage 1215 at a velocity of V/2 are mechanically moved orthogonally to the electrical scanning (main-scanning) direction of the CCD 1101, so that scanning (sub-scanning) is performed over the surface of an original.

As shown in FIG. 8, a control portion 1200 is constituted of a CPU 1301, which has an I/F for exchanging information for controlling a digital image processing portion 1212, an external I/F 1213 and a printer control I/F 1253, an operation portion 1302 and a memory 1303. The operation portion 1302 is constituted of a liquid crystal display with a touch panel which permits an operator to input execution contents and to be notified of information and a warning about processing.

Figure 9:
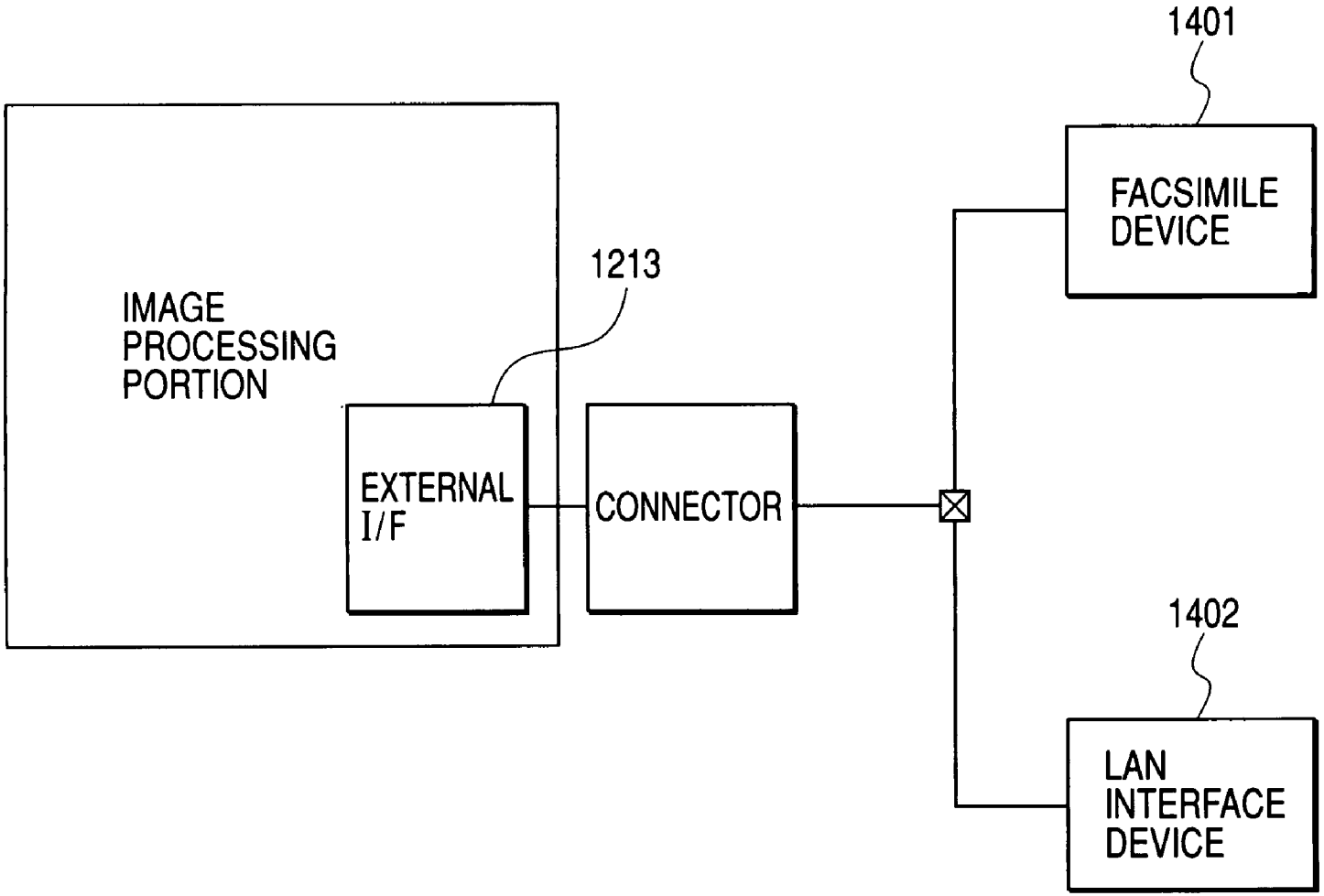
FIG. 9 is a diagram showing the configuration of an external interface.

The external I/F 1213 is an interface for exchanging image information, code information and the like with the outside of the image processing apparatus. To be specific, as shown in FIG. 9, the external I/F 1213 can connect a facsimile 1401, a LAN interface 1402 and so on. Control on the exchange of image information and code information with the facsimile 1401 and the LAN interface 1402 is performed by intercommunication between the CPU 1301 of the control portion 1200 and the connected devices of the facsimile 1401 and the LAN interface 1402.

The digital image processing portion 1212 will be described in detail. FIG. 6 is a block diagram showing the specific configuration of the digital image processing portion 1212.

An original on the platen glass reflects light from the light sources 1203 and 1204, and the reflected light is directed to the CCD 1101 and is converted into an electrical signal (when the CCD 1101 is a color sensor, RGB color filters may be arranged in line in RGB order on a one-line CCD, and an R filter, a G filter and a B filter may be arranged for each CCD in a three-line CCD. A filter may be arranged on-chip or may be arranged separately from a CCD.). Then, the electrical signal (analog image signal) is inputted to the image processing portion 1212 and is subjected to sampling and holding (S/H) in a clamp & Amp. & S/H & A/D portion 1102. The dark level of an analog image signal is clamped at the reference potential, is amplified to a predetermined amount (the processing order is not limited to the illustrated order), and is subjected to AD conversion, so that the signal is converted into a digital signal of 8-bit RGB. Subsequently the RGB signal is subjected to shading correction and black correction in a shading portion 1103. Regarding the corrected RGB signal, in a connection & MTF correction & original detection portion 1104, considering that lines are read on different positions when the CCD 1101 is a three-line CCD, connection processing adjusts a delay amount for each line according to a reading velocity and corrects the signal timing so that three lines are read on the same position. Since the reading MTF is varied according to a reading velocity and a magnification factor, MTF correction corrects a change. Original detection recognizes the size of an original by scanning the original on the platen glass. The digital signal whose reading position timing has been corrected corrects the spectral characteristic of the CCD 1101 and the spectral characteristics of the light sources 1203 and 1204 and the reflecting shades 1205 and 1206 by using an input masking portion 1105. The output of the input masking portion 1105 is inputted to a selector 1106 which can be switched with an external I/F signal. A signal outputted from the selector 1106 is inputted to a color space compression & ground removal & LOG conversion portion 1107 and a ground removal portion 1115. The signal inputted to the ground removal portion 1115 is inputted to a black character determination portion 1116, which decides whether an original has a black character or not, after a ground is removed. Then, a black character signal is generated from the original. In the color space compression & ground removal & LOG conversion portion 1107 having received the other output of the selector 1106, color space compression decides whether a read image signal is within the reproducible range of a printer. When the image signal is within the range, the signal is left as it is. When the image signal is out of the range, the image signal is corrected so as to be within the reproducible range of the printer. Then, a ground is removed and conversion is made from an RGB signal to a CMY signal by LOG conversion. Subsequently, in order to correct timing relative to the signal generated by the black character determination portion 1116, the output signal of the color space compression & ground removal & LOG conversion portion 1107 is adjusted in timing by a delay 1108. The moiré of the two kinds of signals is removed by a moiré removal portion 1109 and is scaled along the main scanning direction by a magnification processing portion 1110. Reference numeral 1111 denotes a UCR & masking & black character reflection portion. Regarding the signal processed in the magnification processing portion, a CMYK signal is generated from the CMY signal by UCR processing and is corrected into a signal according to the output of the printer in a masking portion, and a determination signal generated by the black character determination portion 1116 is fed back to the CMYK signal. The signal processed in the UCR & masking & black character reflection portion 1111 is adjusted in density by a γ correction portion 1112 and is subjected to smoothing or edging by a filter portion 1113.

(Configuration of a Printer Portion)

The following will describe the configuration of a printer portion. FIG. 7 is a structural diagram showing the main part of a full-color printer which is an example of the image forming apparatus according to the present invention.

A photosensitive drum (hereinafter simply referred to as a "photosensitive member") 1225 serving as an image bearing member is provided so as to be rotated along an arrow A by a motor (not shown). A primary electrifier 1221, an exposing apparatus 1218, a black developing unit 1219, a color developing unit 1223, a transfer electrifier 1220 and a cleaner 1222 are disposed around the photosensitive member 1225.

The black developing unit 1219 is a developing apparatus for monochrome development that develops a latent image on the photosensitive member 1225 with toner K. Further, the color developing unit 1223 is constituted of three developing apparatuses 1223Y, 1223M and 1223C for full-color development. The developing apparatuses 1223Y, 1223M and 1223C develop latent images on the photosensitive member 1225 with toners Y, M and C, respectively. At the development with toners of the colors, the developing unit 1223 is rotated along an arrow R by a motor (not shown) and the developing apparatus of the corresponding color is brought into contact with the photosensitive member 1225.

Toner images of the colors that have been developed on the photosensitive member 1225 are sequentially transferred by a transfer electrifier 1220 to a transfer belt 1226 serving as an intermediate transfer body, so that the toner images of four colors are superimposed. The transfer belt 1226 is stretched over rollers 1227, 1228 and 1229. Among the rollers, the roller 1227 is connected to a driving source (not shown) and acts as a driving roller for driving the transfer belt 1226, the roller 1228 acts as a tension roller for adjusting the tension of the transfer belt 1226, and the roller 1229 acts as a backup roller of a transfer roller 1231 serving as a secondary transferring apparatus. Further, a secondary roller attachment/detachment unit 1260 is a driving unit for contacting or separating the secondary transfer roller 1231 to or from the transfer belt 1226. A cleaner blade 1268 is disposed on a position which is opposed to the roller 1227 across the transfer belt 1226. A cleaner blade attachment/detachment unit 1232 is a driving unit for contacting or separating the cleaner blade 1268 to or from the transfer belt 1226. The cleaner blade 1268 is operated in the attaching direction by the cleaner blade attachment/detachment unit 1232, so that residual toner on the transfer belt 1226 is scrubbed away by the blade. Moreover, a toner concentration sensor 1234 is provided to detect a toner concentration on the surface of the transfer belt 1226. The use of the sensor will be described later.

Recording sheet media having been stored in cassettes 1240 and 1241 and a manual feeding portion 1253 are fed via a register roller 1255 and feed roller pairs 1235, 1236 and 1237 to a secondary transfer nip, that is a contact between the secondary transferring apparatus 1231 and the transfer belt 1226. At this point of time, the transfer roller attachment/detachment unit 1260 is driven in the contact direction, so that the secondary transferring apparatus 1231 is brought into contact with the transfer belt 1226. A toner image formed on the transfer belt 1226 is transferred onto the recording sheet medium at the nip and is thermally fixed by a fixing apparatus 1234. Then, the sheet medium is ejected to the outside of the apparatus. The cassettes 1240 and 1241 and the manual feeding portion 1253 have sheet absence detecting sensors 1243, 1244 and 1254 for detecting the presence or absence of a recording sheet medium. Further, the cassettes 1240 and 1241 and the manual feeding portion 1253 have feeding sensors 1247 and 1248 for detecting a faulty pickup of a recording sheet medium.

In the color printer configured thus, an image is formed in the following manner.

First the conveyance of a recording sheet medium in the feeding portion will be described below. Recording media stored in the cassettes 1240 and 1241 and the manual feeding portion 1253 are conveyed one by one onto a feeding path 1266 by pickup rollers 1238, 1239 and 1264. When the recording sheet medium on the feeding path 1266 is conveyed to the register roller 1255 via the feeding roller pairs 1235, 1236 and 1237, the passage of the recording sheet medium is detected by a registration sensor 1256 provided immediately before the feeding roller pairs. When the passage of the recording sheet medium is detected by the registration sensor 1256, the conveyance is temporarily stopped after a proper time has elapsed. As a result, the recording sheet medium makes contact with the stopped register roller 1255 and the conveyance is stopped. At this point of time, the position of the recording sheet medium is fixed so that the end in the traveling direction is perpendicular to a conveying path, and the conveying direction of the recording sheet medium is displaced from the conveying path, so that the conveying direction of the feeding path is corrected in the event of skew feeding. This processing will be referred to as normal feeding registration. Feeding registration is necessary for minimizing the inclination of an image forming direction on the subsequent recording sheet medium. The register roller 1255 is started after the feeding registration, so that the recording sheet medium is fed to the secondary transferring apparatus 1231.

The following will describe the steps of forming an image on the recording sheet medium having been fed to the secondary transferring apparatus 1231. First, voltage is applied to the electrifier 1221 to negatively charge the surface of the photosensitive member 1225 evenly with a predetermined electrification potential. Subsequently, the exposing apparatus 1218 composed of a laser scanner performs exposure so that an image on the electrified photosensitive member 1225 has a predetermined exposure potential. Thus, a latent image is formed. The exposing apparatus 1218 is turned on/off based on an image signal, so that a latent image is formed according to an image.

Figure 10:
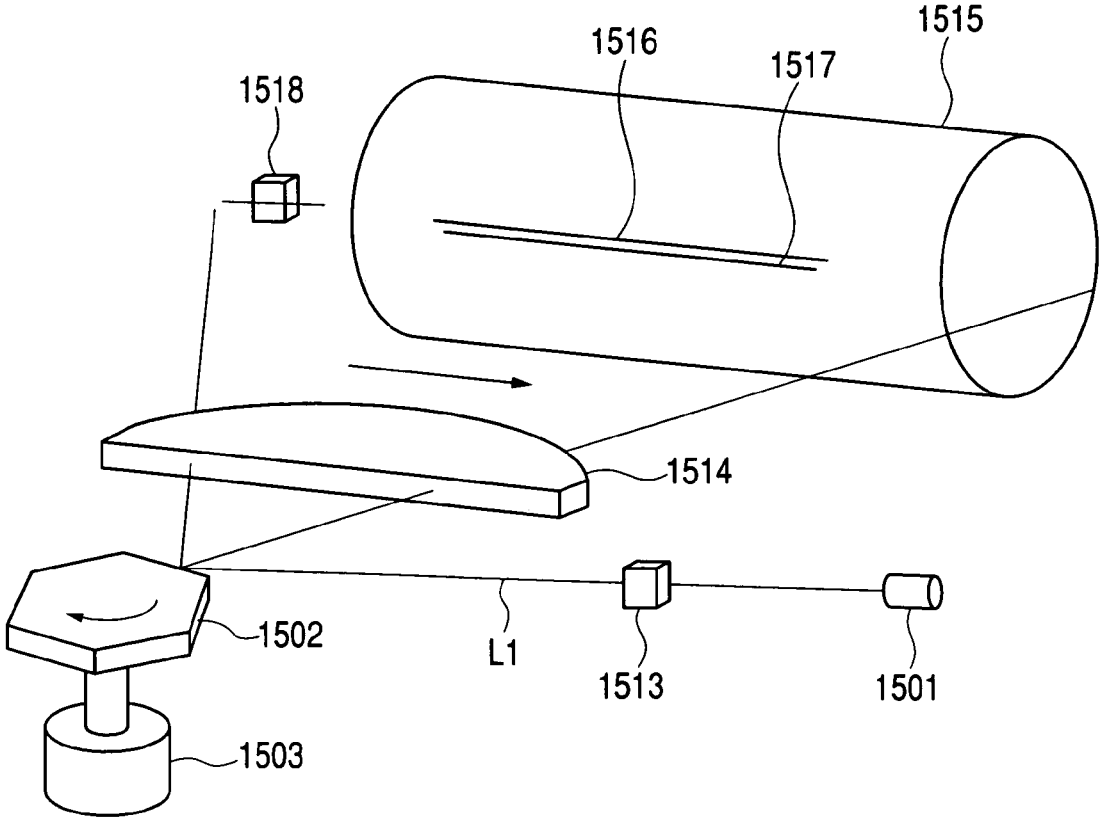
FIG. 10 is a schematic diagram showing the configuration of a laser scanner.

FIG. 10 is a schematic diagram showing the configuration of a laser scanner according to the present embodiment. Light emitted from a laser 1501 is condensed into a laser beam L1 via a condenser lens 1513 (hereinafter referred to as a collimator) and is deflected by a rotating polyhedron 1502, which is rotated by a driving motor 1503, to scan a drum. The deflected laser beam L1 scans a drum 1515 via an image-forming lens 1514 so as to scan the drum 1515 with a constant density. Further, in order to write an image on each line at fixed timing, the laser scanner is constituted of a sensor 1518 (hereinafter referred to as a BD sensor 1518) for detecting the laser beam L1 and generating a horizontal synchronizing signal.

Further, a predetermined developing bias for each color is applied to the developing rollers of the black developing apparatus 1219 and the color developing apparatus 1223. The latent image is developed with toner when passing through the positions of the developing rollers, and thus the latent image is visualized as a toner image. The toner image is transferred to the transfer belt 1226 by the transferring apparatus 1220 and is transferred in the second transfer roller 1231 to a recording sheet medium which has been conveyed from a feeding portion. Thereafter, the recording sheet medium is conveyed to the fixing apparatus 1234 via a fixation conveying belt 1230. In the fixing apparatus 1234, electrification is first performed by pre-fixing electrifiers 1251 and 1252 in order to compensate for the adsorption of the toner and prevent a blurred image. After the toner image is thermally fixed by a fixing roller 1233, a conveying path is switched to an ejecting path 1258 by a discharge flapper 1257 and the sheet medium is ejected as it is to a discharge tray 1243.

In the case of full-color print, toners of four colors are superimposed on the transfer belt 1226 and are transferred to the recording sheet medium. Regarding residual toner on the photosensitive member 1225, the electrification of the toner is prepared for cleaning by an auxiliary cleaning apparatus (not shown), the toner is removed and collected by the cleaner 1222, and the static electricity of the photosensitive member 1225 is finally eliminated evenly to about 0 volt by a static eliminator (not shown) so as to be prepared for the subsequent image forming cycle.

The timing of the image formation of the color printer is controlled relative to a predetermined position on the transfer belt 1226. The transfer belt 1226 is stretched over rollers consisting of the driving roller 1227, the tension roller 1228 and the backup roller 1229. A predetermined tension is applied by the tension roller 1228.

Reflecting sensors 1234(*a*) and 1234(*b*) for detecting the reference position are disposed between the driving roller 1227 and the roller 1229. The reflecting sensors 1234(*a*) and 1234(*b*) are disposed on both ends of the outer periphery of the transfer belt 1226, detect markings such as reflecting tapes disposed on opposed positions on the surface of the transfer belt 1226, and alternately output signals I-top(a) and I-top(b) every time the transfer belt 1226 goes halfway around.

The integer ratio of the circumference of the photosensitive member 1225 to the circumference of the transfer belt 1226 is 1:n (n is an integer). With such a setting, while the transfer belt 1226 rotates around the rollers, the photosensitive member 1225 rotates a whole number of times and returns to completely the same state as before the rotation of the transfer belt 1226. Thus, when four colors are superimposed on the intermediate transfer belt 1226 (the belt rotates four times), it is possible to prevent an uneven rotation of the photosensitive member 1225 from causing a color drift.

In such an image forming apparatus using the intermediate transfer method, after one of the signals I-top (a) and I-top(b) is detected, exposure is started by the exposing apparatus 1218, which is composed of a laser scanner, after a predetermined time has elapsed. In this case, any difference is not made between the signals I-top (a) and I-top(b). The firstly detected signal acts as a trigger and starts exposure.

Moreover, in the case of an image on a short sheet, the transfer belt 1226 has a length permitting the formation of two toner images. Particularly when a color image is formed with four superimposed colors, images on two pages can be formed only in the time of four rotations of the belt, thereby increasing productivity. This image forming method will be referred to as double image formation.

In the double image formation according to the present embodiment, two images are formed while the signals I-top (a) and I-top (b) of the transfer belt 1226 serve as trigger signals (In this case, the preceding image will be referred to as image A and the subsequent image will be referred to as image B for convenience). However, image A and image B are not evenly spaced on the transfer belt 1226 and a distance from image A to image B is larger than a distance from image B to image A. In consideration of the flow of image formation, written toner images have different colors between image B and image A and thus the color developing unit 1223 has to switch the three developing apparatuses 1223Y, 1223M and 1223C for full-color development during the image formation. Consequently, a time margin is necessary for driving the rotation of the developing unit 1223 for performing the switching. Also in the case of double image formation, any one of the signals I-top(a) and I-top(b) may be used first to start writing images.

Subsequently operations for forming an image on the back of a recording sheet medium will be discussed in detail. When an image is formed on the back of a recording sheet medium, an image is formed first on the surface of the recording sheet medium. The image formation on the surface was described above in detail and thus the explanation thereof is omitted. When an image is formed only on the surface, a toner image is thermally fixed by the fixing apparatus 1234 after the image formation, and then a conveying path is switched to an ejecting path 1238 by the discharge flapper 1257. Subsequently the recording sheet medium is ejected as it is to the discharge tray 1243. In the case where an image is subsequently formed on the back, the conveying path is switched to a back path 1259 by the discharge flapper 1257, and the accompanying rotation of reverse rollers 1260 temporarily conveys the recording sheet medium into a double-side reversing path 1261. The recording sheet medium is conveyed into the double-side reversing path 1261 by a width in the conveying direction of the sheet medium, the traveling direction is switched by the reverse rotation of the reverse rollers and the driving of double-side path conveying rollers 1262, and an image surface having an image formed thereon is conveyed facedown to a double-side path 1263.

Subsequently, when the recording sheet medium is conveyed over the double-side path 1263 to re-feeding rollers 1264, the passage of the recording sheet medium is detected by a re-feeding sensor 1265 provided immediately before the re-feeding rollers. In the present embodiment, when the passage of the recording sheet medium is detected by the re-feeding sensor 1265, the conveyance is temporarily stopped after a proper time has elapsed. As a result, the recording sheet medium makes contact with the re-feeding rollers 1264 and the conveyance is temporarily stopped. At this point of time, the position of the recording sheet medium is fixed so that the end in the traveling direction is perpendicular to a conveying path, and correction is performed on the conveying direction of the re-feeding path when skew feeding is caused by a displacement of the conveying direction of the recording sheet medium from the conveying path of the re-feeding path. This processing will be referred to as normal re-feeding registration. Re-feeding registration is necessary for minimizing the inclination of an image forming direction on the back of the subsequent recording sheet medium. The re-feeding rollers 1264 are started after the re-feeding registration, so that the recording sheet medium is conveyed again to the feeding path 1266 while being flipped over. The subsequent image formation is performed in the same manner as the surface of the sheet medium and thus explanation thereof is omitted. For the recording sheet medium having images formed on both sides, a conveying path is switched to the ejecting path 1238 by the discharge flapper 1257. The recording sheet medium is ejected as it is to the discharge tray 1243. With such operations, the present embodiment permits an operator to automatically form images on both sides of a sheet medium without the necessity for setting the front and back sides of the sheet medium.

Referring to the chart of FIG. 11, the timing of forming a color image will be described in detail. The double image formation will be used as an example.

Figure 11:
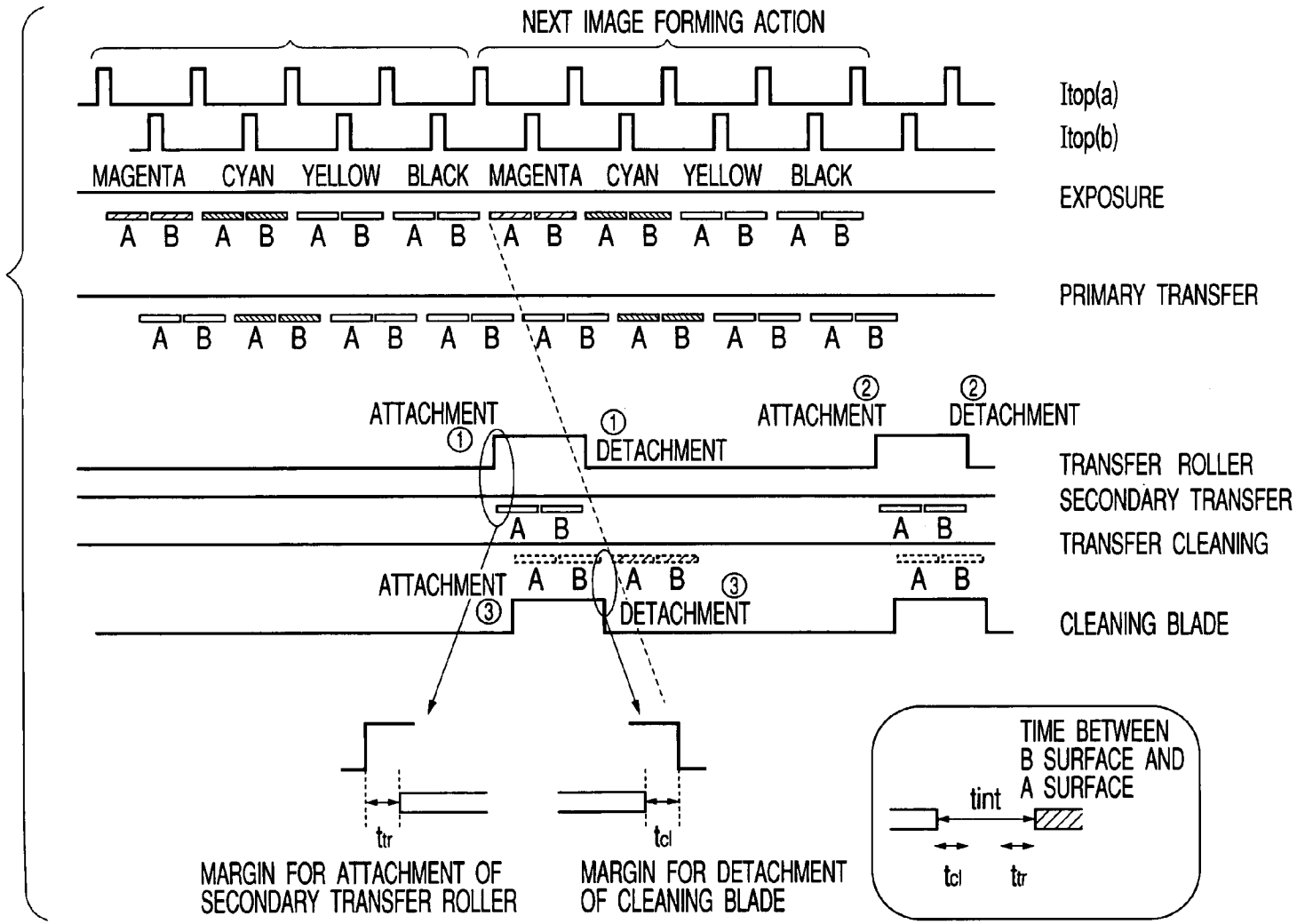
FIG. 11 is a timing chart showing the timing of forming a color image according to Embodiment 2.

As shown in FIG. 11, the signal I-top(a) triggers the exposure of a magenta image on image A and the signal I-top(b) on the transfer belt 1226 subsequently triggers the exposure of a magenta image on image B. The images having started its formation are transferred onto the transfer belt 1226 by primary transfer. In this case, since only magenta images are formed, secondary transfer or cleaning are not performed and cyan images are formed by primary transfer again. Therefore, the transfer roller 1231 and the cleaning blade 1268 remain detached in this state. After rotations are similarly made for yellow and black, the transfer roller 1231 is attached to perform secondary transfer and the cleaning blade 1268 is subsequently attached to scrub away toner having not being transferred.

Considering only the fact that cleaning is positively performed without cleaning an image portion, it seems that the secondary transfer roller 1231 and the cleaning blade 1268 have to be attached between the rear end of yellow on B surface and the leading end of black on A surface and similarly detachment has to be performed between the rear end of black on B surface and the leading end of magenta on surface A of the subsequent image formation.

However, the present invention requires another condition that the detachment of the cleaning blade on the transfer belt 1226 has to be out of an image area of the subsequent image formation and the detachment also has to be caused to pass through the secondary transfer position before the attachment of the secondary transfer roller 1231, the attachment being performed before the leading end of black on surface A reaches the secondary transfer position in the subsequent image formation. This is because when the cleaning blade is detached from the transfer belt 1226, residual toner remains like lines on the transfer belt 1226 and the residual toner may adhere to the secondary transfer roller when the transfer roller 1231 is attached to form the subsequent image.

FIG. 11 show that this idea is applicable to the relationship between detachment (3), which is a position for detaching the cleaning blade, and attachment (2), which is a position for attaching the secondary roller in the subsequent image formation. That is, control is preferably performed so that detachment (3) of the cleaning blade on the transfer belt is positioned out of an image area in the subsequent image formation and passage is made through the secondary transfer position before. attachment (2) of the secondary roller.

Reference character ttr in FIG. 11 denotes a time from contact made by the secondary transfer roller to the edge of an image portion, when the secondary transfer roller preceding the image portion is in contact. Further, reference character tcl denotes a time from the rear end of the image portion to the detachment of the cleaning blade.

If the residual toner adheres to the transfer roller 1231, the residual toner would be transferred to the back of the subsequent recording sheet medium and cause a stain on the back. In worse cases, the residual toner would adhere to the belt between the sheets again and cause a stain in an image area. For this reason, in the present embodiment, the image formation is completed so that completion is made before the position for detaching the cleaning blade 1268 reaches the position for attaching the transfer roller 1231. That is, control is performed so that the position for separating the cleaning means does not overlap an image area or a contact area of a contacting operation performed afterward by the second transfer means. Thus, it is possible to prevent a residue, which occurs on the intermediate transfer body at the separation of the cleaning means, from appearing on the transferring material.

Figure 12:
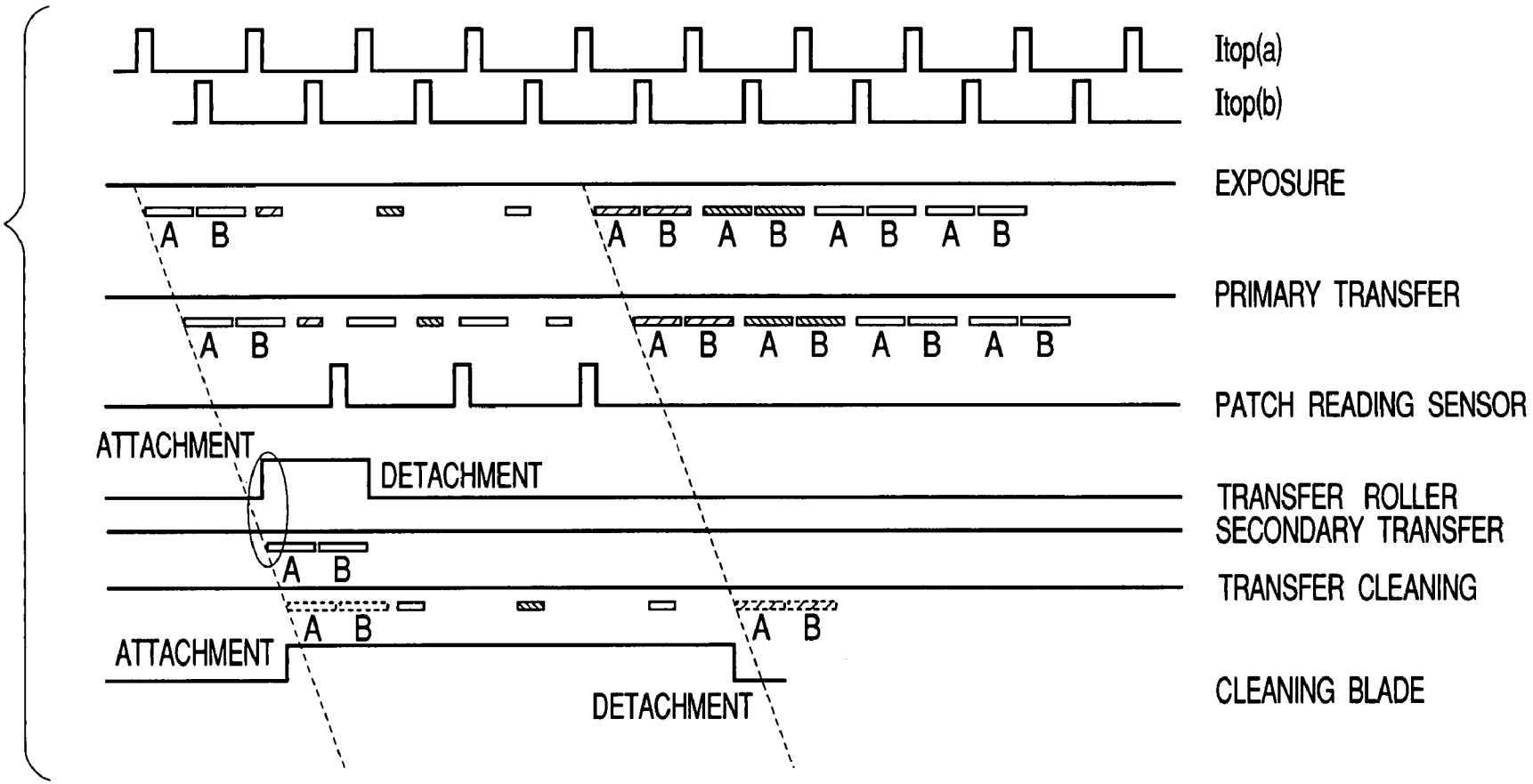
FIG. 12 is a timing chart showing the timing of detecting an image density according to Embodiment 2.

Moreover in the present embodiment, an image density detecting operation for correcting a toner supply is performed to prevent a concentration of toner from decreasing or causing a faulty image during a color image formation. This operation will be described in detail in accordance with the chart of FIG. 12.

The image density detecting operation is performed during color image formation. After an image of the fourth color (i.e. black) is formed, when it is decided that the detecting operation is necessary, a patch image for detecting a toner concentration is formed. The patch image is an image having a predetermined fixed concentration. An image density of the image on the transfer belt 1232 is read by a toner concentration detecting sensor 1269. In the present embodiment, it is decided according to the reading results whether a toner supply is sufficient or not and the supply is corrected. Such patch image formation and reading are performed for three colors of magenta, cyan and yellow (in the present embodiment, a mechanism for directly detecting the remaining amount of toner is provided for black and thus image density is not detected for black). Since the patch image after detection is not transferred to a recording sheet medium, the toner is scrubbed away by the cleaning blade 1268. Further, since multiple transfers are not necessary for the patch image, the cleaning blade 1268 remains attached to scrub away residual toner of the previous image formation. When the last yellow toner is scrubbed away, the cleaning blade 1268 is detached for the subsequent image formation.

Regarding the timing of detachment, considering that only a patch image is scrubbed away, the patch image has a smaller area than a normal image and thus the cleaning blade 1268 can be detached quickly. However, in this case, residual toner at the detachment of the cleaning blade 1268 remains in an image area in the end. Therefore, also in this case, the detachment of the cleaning blade 232 has to be controlled so that the position for detaching the blade on the transfer belt does not overlap the subsequent image forming area or the position for contacting the secondary transfer roller, as illustrated in FIG. 11.

Figure 13:
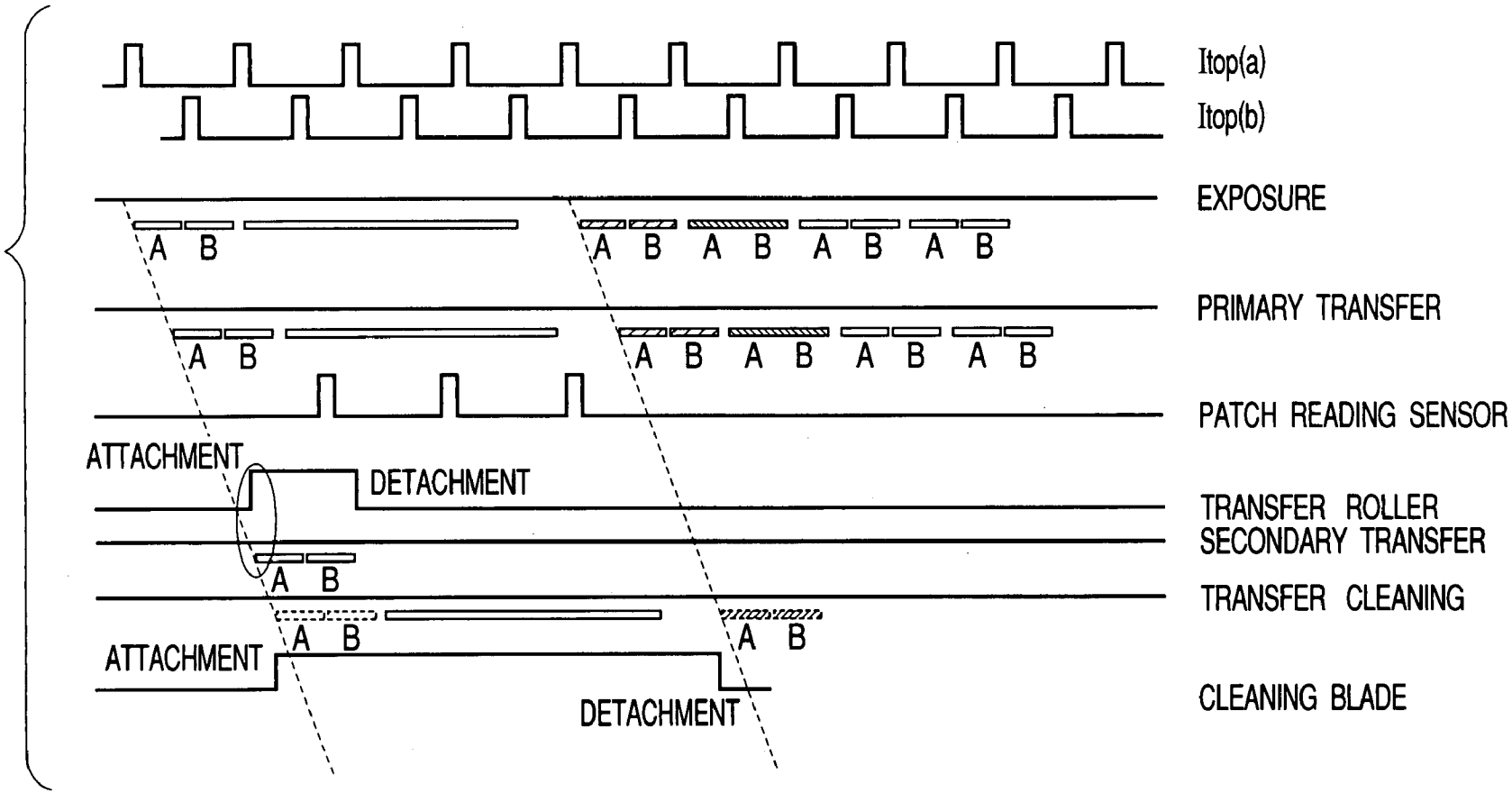
FIG. 13 is a timing chart showing the timing of writing a toner belt according to Embodiment 2.

In the present embodiment, a friction may become too large between the cleaning blade and the intermediate transfer body and resistance may curl up the blade. Thus, a so-called toner belt writing operation is performed as follows: a black toner belt is placed as a lubricant on the intermediate transfer body by force and is scrubbed away by the cleaning blade. The detail of the operation will be discussed in detail in accordance with the chart of FIG. 13.

The toner belt writing operation is performed during the color image formation. After an image of the fourth color (i.e. black) is formed, when it is decided that the operation is necessary, a black toner belt image is formed. The length of the black toner belt image is determined according to the consumption of other color toners.

The formed black toner belt is directly scrubbed away by the cleaning blade 1268 and thus the surface lubricity of the cleaning blade 1268 is improved. The cleaning blade 1268 remains attached to scrub away the residual toner of the previous image formation and is detached for the subsequent image formation after the black belt is scrubbed away.

Regarding the timing of detachment, considering that only a black belt image is scrubbed away, the cleaning blade 1268 can be detached quickly at the end of the black belt image. However, in this case, residual toner at the detachment of the cleaning blade 1268 remains in an image area in the end. Therefore, also in this case, the detachment of the cleaning blade 1268 has to be controlled so that the position for detaching the blade on the transfer belt does not overlap the subsequent image forming area or the position for contacting the secondary transfer roller, as illustrated in FIG. 11.

In the present embodiment, when image formation cannot be continued due to a jam of a recording sheet medium, an error and an accidental power shutdown, image formation is stopped immediately. However, since the intermediate transfer method is used, the operation may have to stop with a toner image formed on the transfer belt 1226.

In this case, a jam of a recording sheet medium is removed, recovery is made from error, or the power is turned on again to start an initial operation. Then, the toner image on the transfer belt 1226 is scrubbed away by the cleaning blade 1268 for the subsequent image formation.

In the present embodiment, also in the detachment of the cleaning blade 1268 after the transfer belt 1226 is cleaned, in consideration of a position for starting the subsequent image formation, the detachment is performed on a position out of an image area and the attaching area of the transfer roller 1231.

In the present embodiment, two kinds of conveying velocity are switched depending upon whether a recording sheet medium is a cardboard or an ordinary paper. When the recoding sheet medium is a cardboard, a heat capacity is large and thus a sufficient amount of heat may not be supplied when the fixing apparatus 1234 is caused to pass at a normal speed. As a result, a problem such as an unfixed portion may arise. For this reason, the cardboard is caused to pass at lower speed than an ordinary paper so as to apply a sufficient amount of heat thereon from the fixing apparatus 1234. However, the image forming apparatus of the present embodiment is small in size and thus a conveying distance is not sufficiently large between the image transferring portion and the fixing portion. Hence, the transfer of an image and thermal fixation have to be performed simultaneously on the same sheet medium. In order to reduce a fixing speed, the speed of transferring an image has to be reduced accordingly.

Referring to FIGS. 14A to 14D, the following will describe the low-speed transfer and the fixing operation of the present embodiment that are performed during the conveyance of a cardboard.

Figure 14A:
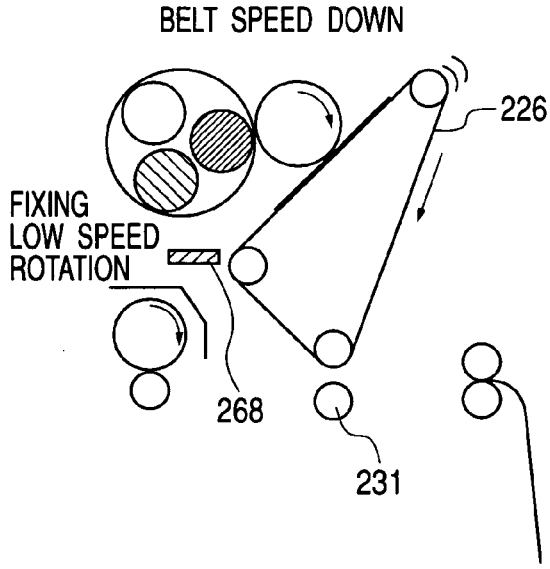
FIGS. 14A, 14B, 14C and 14D are schematic diagrams showing a low-speed transfer and a fixing operation when a cardboard is conveyed.
Figure 14B:
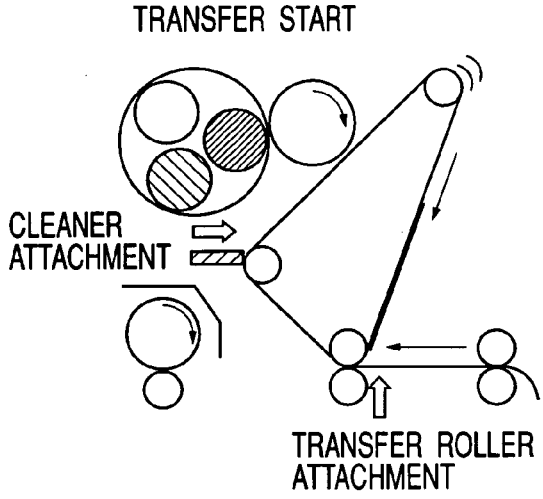
Figure 14C:
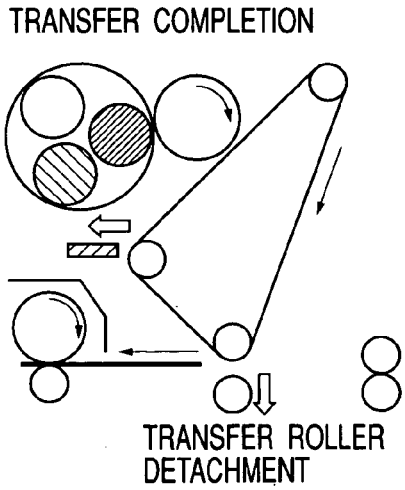
Figure 14D:
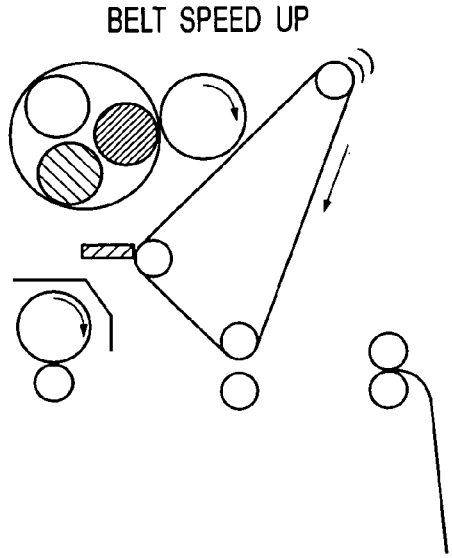
Figure 15:
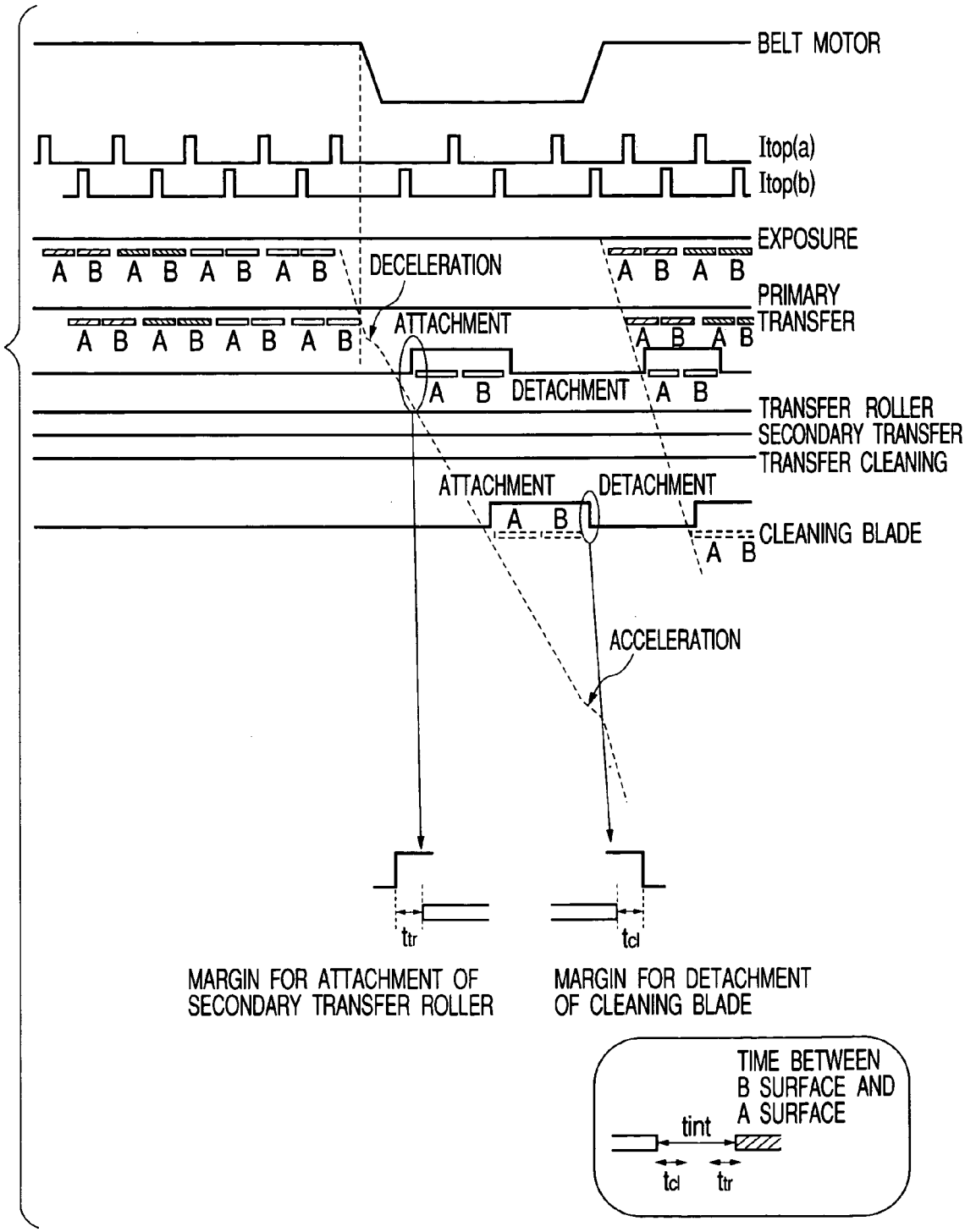
FIG. 15 is a timing chart showing the timing of low-speed transfer when a cardboard is conveyed.

Since the intermediate transfer method is used in the present embodiment, a toner image does not always have to be formed on the transfer belt 1226 in synchronization with the retransfer of a toner image from the transfer belt 1226 to a recording sheet medium. That is, regarding a toner image formed on the transfer belt 1226, by operating the transfer roller attachment/detachment unit 1250 and the cleaner blade attachment/detachment unit and moving the transfer roller 1231 and the cleaning blade 1268 in the detaching direction, the transfer belt 1226 can be turned free while maintaining the toner image on the transfer belt 1226. As shown in FIG. 14A, after a toner image is formed on the transfer belt 1226, the rotational speed of the transfer belt 1226 is reduced. Then, when the rotation of the belt at a desired low speed is stabilized, the recording sheet medium is fed at the corresponding low speed, the transfer roller attachment/detachment unit 1250 is driven to attach the transfer roller 1231 to the transfer belt 1226, and retransfer is performed at the same low speed (FIG. 14B). The retransferred recording sheet medium is conveyed to the fixing roller 1233 at the same low speed. The fixing roller 1233 has been driven according to the low speed of the transfer belt 1226, fixing is performed thereon, and the recording sheet medium is ejected out of the apparatus (FIG. 14C). The transfer belt 1226 where transfer has been completed returns to a normal speed. Meanwhile, the cleaner blade attachment/detachment unit 1268 is operated, toner which has not been transferred and remains on the belt is cleaned by the cleaner blade 1232, and the subsequent image is formed (FIG. 14D). The timing of color image formation and the operation of the cleaning blade 1232 of this case will be described in detail in accordance with the chart of FIG. 15.

After the toner image is transferred, the transfer belt 1226 reduces speed. At a stable low-speed rotation, the transfer roller 1231 is attached to perform secondary transfer on the recording sheet medium. Subsequently the cleaning blade 1268 is attached to scrub away toner having not been transferred.

Thereafter, the transfer belt 1226 returns to a normal speed. In the present embodiment, the cleaning blade 1268 at that time is detached on a position out of an image area and the attaching area of the transfer roller 1231 relative to the position for starting writing an image with the first Itop signal serving as a trigger after the transfer belt 1226 returns to the normal speed. With this detachment, even when a speed is varied, residual toner caused by the detachment of the cleaning blade 1268 upon transferring does not affect an image in the present embodiment.

Figure 16:
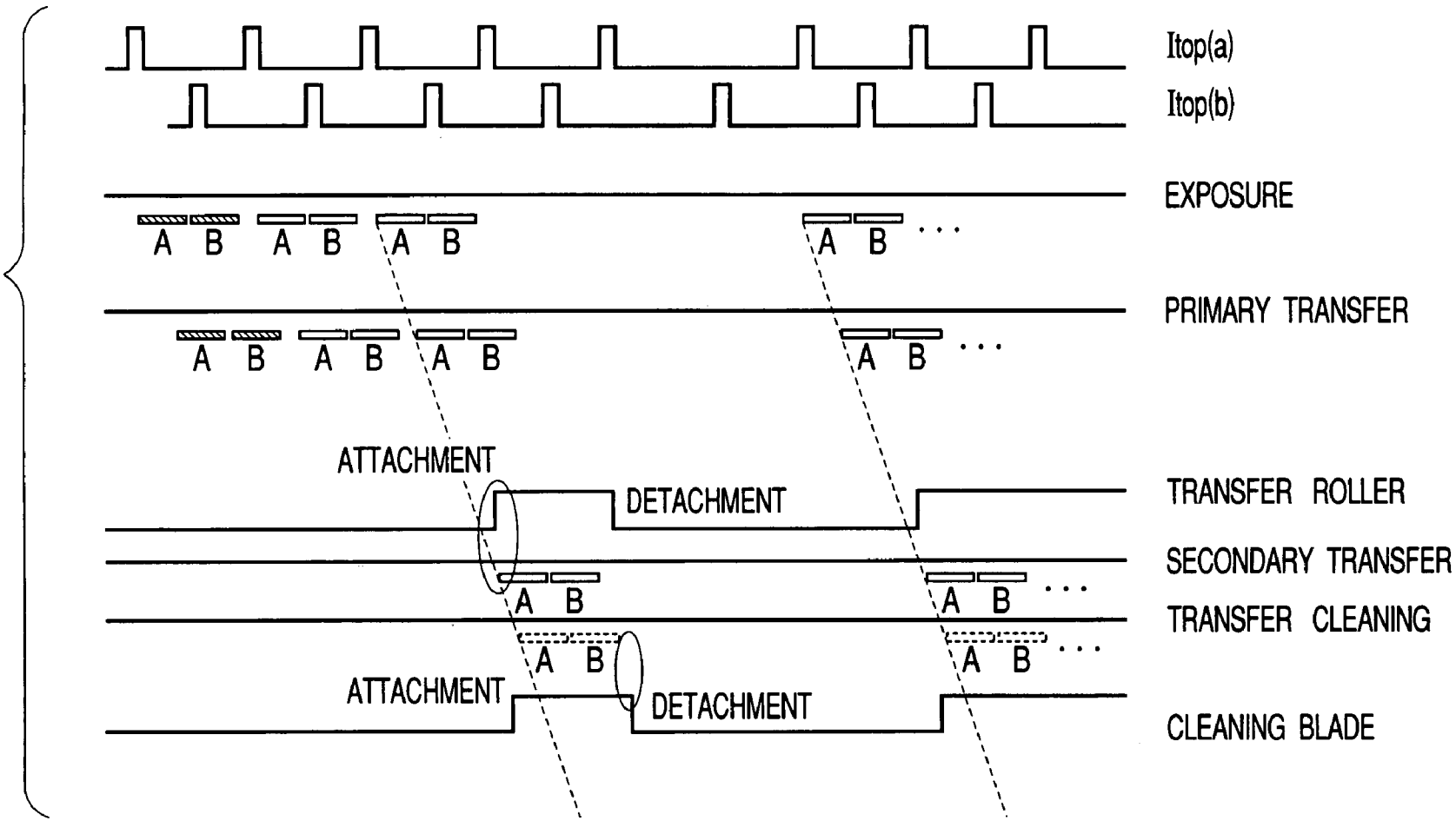
FIG. 16 is a timing chart showing control timing for keeping residual toner out of an image area and the attaching area of a transfer roller when a monochrome image is printed.

Further in the present embodiment, in order to prevent residual toner of the cleaning blade 1268 from adversely affecting an image forming area, an image is formed based on the Itop signal even when a monochrome image with no color drift is printed. By controlling the detachment of the cleaning blade 1268 beforehand based on the Itop signal, residual toner does not remain in an image area or the attaching area of the transfer roller 1231. The timing of image formation and the timing of operating the cleaning blade 1268 are shown in the chart of FIG. 16.

Moreover, in the present embodiment, the signals I-top(a) and I-top(b) are alternately outputted by sensors 1224(*a*) and 1224(*b*) every time the transfer belt 1226 goes halfway around. Any one of the signals can act as a trigger for starting image formation. However, in order to prevent residual toner, which is caused by the detachment of the cleaning blade 1268 at the completion of the previously performed image formation, from being disposed in the image area and the attaching area of the roller 1231, the I-top signal for starting image formation has to be detected while considering which of the I-top signals is used for the detachment of the cleaning blade 1268. The timing of image formation and the timing of operating the cleaning blade 1268 are shown in the charts of FIGS. 17A and 17B.

Figure 17A:
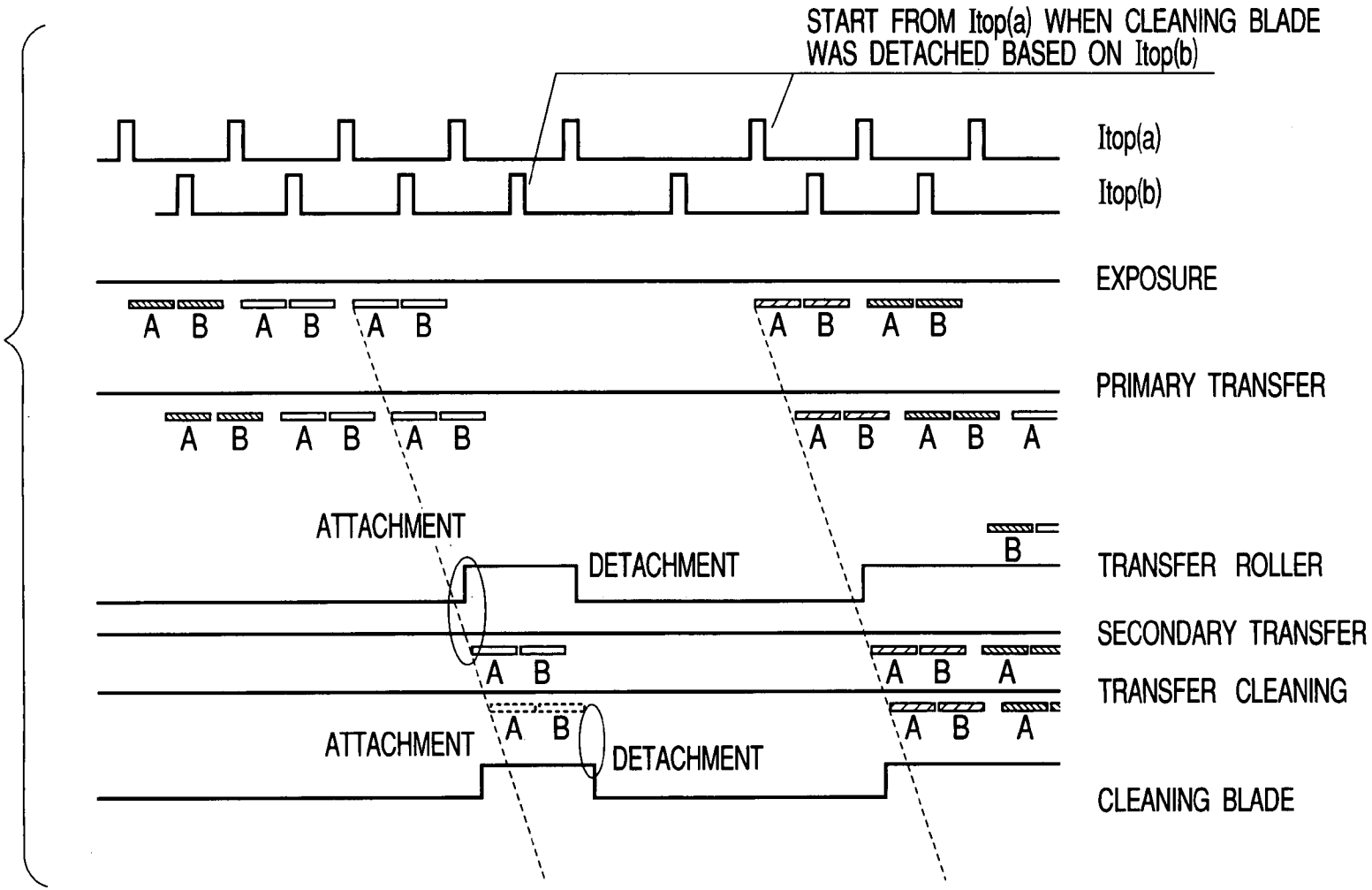
FIGS. 17A and 17B are timing charts showing control timing for keeping residual toner out of an image area corresponding to a plurality of Itop signals and the attaching area of a transfer roller.
Figure 17B:
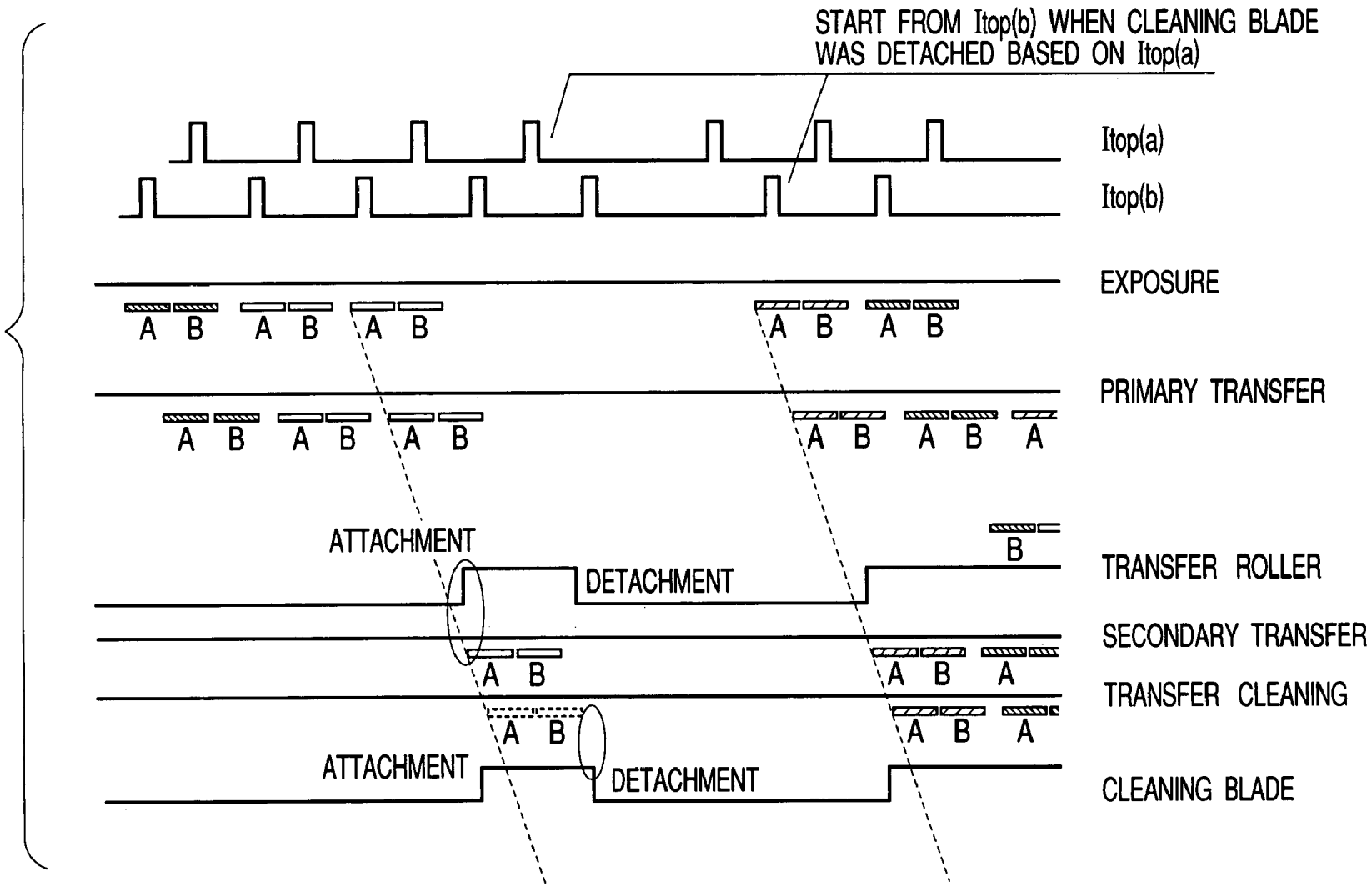

As shown in FIG. 17A, in a series of image forming operations which have been already performed, when it is assumed that the final image formation is performed based on the signal I-top(b), the first image formation of an image forming operation to be subsequently performed is started based on the signal I-top(a). As shown in FIG. 17B, in a series of image forming operations which have been already performed, when it is assumed that the final image formation is performed based on the signal I-top(a), the first image formation of an image forming operation to be subsequently is started based on the signal I-top(b).

Another Embodiment

In the present embodiment, as a method for preventing residual toner, which occurs at the detachment of the cleaning blade 1268 when the conveying speed is switched, from being positioned in an image area and the attaching area of the transfer roller 1231, the cleaner blade 1268 is detached in synchronization with the Itop signal after return is made to a normal speed. Regarding the timing of operation, the cleaner blade 1268 may be detached in synchronization with the Itop signal detected in a low-speed rotation before return is made to the normal speed, as long as residual toner is positioned out of an image area and the attaching area of the transfer roller 1231 in the end.

In the present embodiment, home position sensors generate the two signals Itop(a) and Itop(b). The number of sensors is not particularly limited to two. A single sensor and two or more sensors are also applicable.

In the present embodiment, the image density detecting operation and the toner belt writing operation were described as representative examples of image adjustment performed in image formation. Image adjustment performed in the formation of a target image is not particularly limited to the two examples. When a cleaning blade 268 is attached and detached, it is needless to say that control can be similarly performed to avoid an image area and the attaching area of the transfer roller 231.

The present invention is not limited to the above-described embodiment. Technical ideas described below and every combination of the technical ideas are also included.

What is claimed is:

1. An image forming apparatus, comprising:

image forming means for forming an image on an image bearing member;

first transfer means for transferring the image on said image bearing member onto an intermediate transfer body at a first transfer position;

second transfer means which includes a transfer member attachable to and detachable from said intermediate transfer body and transfers the image on said intermediate transfer body onto a transferring material at a second transfer position;

cleaning means which includes a cleaning member attachable to and detachable from said intermediate transfer body, brings said cleaning member into contact with a surface of said intermediate transfer body, and cleans a contact surface of said intermediate transfer body; and control means for performing a control so that a subsequent image forming area does not overlap at a position where said cleaning member initially contacts said intermediate transfer body and is not cleaned by said cleaning means.

2. An image forming apparatus, comprising:

image forming means for forming an image on an image bearing member;

first transfer means for transferring the image on said image bearing member onto an intermediate transfer body at a first transfer position;

second transfer means which includes a transfer member and transfer output means and transfers the image on said intermediate transfer body onto a transferring material at a second transfer position, said transfer member being attachable to and detachable from said intermediate transfer body, said transfer output means applying a transfer output to said transfer member;

said second transfer means performing a voltage-current detection operation on said transfer member when no image is formed and determining the transfer output of the transferring operation based on a detection result of the detection operation;

cleaning means which has a cleaning member attachable to and detachable from said intermediate transfer body, brings said cleaning member to a surface of said intermediate transfer body, and cleans a contact surface of said intermediate transfer body; and control means for performing a control so that a detection area of the detection operation does not overlap at a position where said cleaning member initially contacts said intermediate transfer body or separates from said intermediate transfer body and is not cleaned by said cleaning means.

3. An image forming apparatus, comprising:

image forming means for forming an image on an image bearing member, first transfer means for transferring the image on said image bearing member onto an intermediate transfer body at a first transfer position;

second transfer means which includes a transfer member attachable to and detachable from said intermediate transfer body and transfers the image on said intermediate transfer body onto a transferring material at a second transfer position;

cleaning means which includes a cleaning member attachable to and detachable from said intermediate transfer body, brings said cleaning member into contact with a surface of said intermediate transfer body, and cleans a contact surface of said intermediate transfer body; and control means for performing a control so that a contact area in a subsequent contacting operation of said transfer member and an image forming area do not overlap at a position where said cleaning member separates from said intermediate transfer body and is not cleaned by said cleaning means.

4. The image forming apparatus according to claim 3, further comprising a position reference portion provided on said intermediate transfer body; and position detecting means for detecting said position reference portion, wherein the control means performs a control based on information from said position detecting means.

* * * * *

UNITED STATES PATENT AND TRADEMARK OFFICE

CERTIFICATE OF CORRECTION

PATENT NO. : 6,990,298 B2
APPLICATION NO. : 10/786117
DATED : January 24, 2006
INVENTOR(S) : Shigemichi Hamano et al.

It is certified that error appears in the above-identified patent and that said Letters Patent is hereby corrected as shown below:

COLUMN 5:

Line 13, “an” should be deleted; and
Line 14, “image digital image” should read --a digital image--.

COLUMN 17:

Line 59, “show” should read --shows--.

COLUMN 21:

Line 13, “is” should be deleted; and
Line 43, “embodiment.” should read --embodiments.--.

COLUMN 22:

Line 35, “member,” should read --member;--.

Signed and Sealed this

Twenty-second Day of August, 2006

JON W. DUDAS
*Director of the United States Patent and Trademark Office*